US012369682B2

(12) United States Patent
Ishikawa et al.

(10) Patent No.: US 12,369,682 B2
(45) Date of Patent: Jul. 29, 2025

(54) SHOE SOLE AND SHOE

(71) Applicant: ASICS CORPORATION, Kobe (JP)

(72) Inventors: Tatsuya Ishikawa, Kobe (JP); Koji Otobe, Kobe (JP); Sho Takamasu, Kobe (JP); Tomoichiro Ozaki, Kobe (JP); Hiroyuki Ichikawa, Kobe (JP)

(73) Assignee: ASICS CORPORATION, Kobe (JP)

( * ) Notice: Subject to any disclaimer, the term of this patent is extended or adjusted under 35 U.S.C. 154(b) by 18 days.

(21) Appl. No.: 18/556,292

(22) PCT Filed: Apr. 20, 2021

(86) PCT No.: PCT/JP2021/016027
§ 371 (c)(1),
(2) Date: Oct. 19, 2023

(87) PCT Pub. No.: WO2022/224348
PCT Pub. Date: Oct. 27, 2022

(65) Prior Publication Data
US 2024/0215680 A1 Jul. 4, 2024

(51) Int. Cl.
*A43B 13/12* (2006.01)
*A43B 13/18* (2006.01)

(52) U.S. Cl.
CPC ..... *A43B 13/122* (2013.01); *A43B 13/186* (2013.01)

(58) Field of Classification Search
CPC ..... A43B 13/12; A43B 13/122; A43B 13/125; A43B 13/186; A43B 13/141; A43B 13/184; A43B 13/13; A43B 13/26; A43B 13/145
See application file for complete search history.

(56) References Cited

U.S. PATENT DOCUMENTS

2007/0193065 A1* 8/2007 Nishiwaki ..... A43B 21/265 36/35 B
2011/0197469 A1 8/2011 Nishiwaki et al.
2013/0212909 A1* 8/2013 Bates ..... A43B 13/203 36/102

(Continued)

FOREIGN PATENT DOCUMENTS

WO 2010/049983 A1 5/2010

OTHER PUBLICATIONS

International Search Report issued in PCT/JP2021/016027; mailed Jun. 29, 2021.

*Primary Examiner* — Patrick J. Lynch
(74) *Attorney, Agent, or Firm* — Studebaker Brackett PLLC

(57) ABSTRACT

A shoe sole includes a midsole and an outsole. The midsole has a first protruding portion at a location on a medial foot side and a rear end side of the shoe sole, and the outsole has a first cover portion covering the first protruding portion. The first cover portion includes a first bottom wall portion prescribing a ground contact surface, and a first side wall portion erected from a peripheral edge of the first bottom wall portion on the medial foot side. A first ridgeline that is a boundary between the first bottom wall portion and the first side wall portion is located so as to separate from a first outline of the first cover portion prescribed by the first side wall portion from a front side specific location toward a rear side specific location, in a case when seen along a normal direction of the ground contact surface.

13 Claims, 14 Drawing Sheets

(56) References Cited

U.S. PATENT DOCUMENTS

| | | | | |
|---|---|---|---|---|
| 2015/0272271 | A1* | 10/2015 | Campos, II | A43B 13/16<br>36/29 |
| 2016/0255911 | A1* | 9/2016 | Fujita | A43B 13/12 |
| 2016/0302522 | A1* | 10/2016 | Meschter | A43B 13/181 |
| 2016/0324264 | A1* | 11/2016 | Johnson | A43B 3/244 |
| 2018/0199666 | A1* | 7/2018 | Moriyasu | A43B 13/16 |
| 2020/0305541 | A1* | 10/2020 | Yahata | A43B 13/127 |
| 2021/0307452 | A1* | 10/2021 | Cin | A43B 13/188 |

* cited by examiner

SHOE SOLE AND SHOE

TECHNICAL FIELD

The present invention relates to a shoe sole, and a shoe including the shoe sole.

BACKGROUND ART

For example, WO 2010/049983 A (PTL 1) discloses a shoe in which a compressive rigidity of a rearfoot portion on a medial foot side is higher than a compressive rigidity of the rearfoot portion on a lateral foot side, and as a result of this, the generation of overpronation is suppressed.

CITATION LIST

Patent Literature

PTL 1: WO 2010/049983 A

SUMMARY OF INVENTION

Technical Problem

However, in a shoe used for a specific usage, there may be cases where it cannot necessarily be said to be suitable to adopt a configuration such as disclosed in PTL 1. For example, in a shoe used for an athletic sport for which it is necessary to frequently perform a change in direction (a so-called cutting maneuver), in the case where a compressive rigidity of a rearfoot portion on a medial foot side is high, there will be a deterioration in an impact absorbing performance in this portion at the time of a cutting maneuver.

Accordingly, in particular, in a shoe used for such a type of athletic sport, it is preferable to be excellent in both stability when in a standing posture and an impact absorbing performance at the time of a cutting maneuver, and an improvement in this point has been strongly demanded.

Therefore, an object of the present invention, which has been made to solve the above-stated problem, is to provide a shoe sole in which stability when in a standing posture and an impact absorbing performance at the time of a cutting maneuver are made compatible, and a shoe including the shoe sole.

Solution to Problem

A shoe sole based on the present invention is a shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are provided to be connected along a front-rear direction that is a direction coinciding with a foot length direction of the foot of the wearer, the shoe sole including a midsole and an outsole. The midsole is provided so as to straddle across the forefoot portion, the midfoot portion, and the rearfoot portion. The outsole prescribes a ground contact surface when in a standing posture by covering at least a part of the midsole on a lower surface. The midsole has a first protruding portion protruding toward the ground contact surface side at a location on a medial foot side in a left-right direction that is a direction coinciding with a foot width direction of the foot of the wearer and on a rear end side in the front-rear direction. A portion of the midsole where the first protruding portion is provided includes a first bottom surface located on the ground contact surface side, and a first side surface located on the medial foot side in the left-right direction when seen from the first bottom surface. The outsole has a first cover portion including a first bottom wall portion prescribing the ground contact surface by covering the first bottom surface, and a first side wall portion erected facing upward from a peripheral edge of the first bottom wall portion on the medial foot side in the left-right direction and covering the first side surface. In a case where a front side end of the shoe sole based on the present invention in the front-rear direction is set as a reference, a location corresponding to a dimension of 70% of a dimension from the front side end to a rear side end of the shoe sole in the front-rear direction is set as a front side specific location, and a location of the first bottom wall portion on a rear end side in the front-rear direction is set as a rear side specific location, a first ridgeline of the first cover portion located at a boundary between the first bottom wall portion and the first side wall portion is located so as to separate from a first outline of the first cover portion prescribed by the first side wall portion from the front side specific location toward the rear side specific location in a case when seen along a normal direction of the ground contact surface.

A shoe based on the present invention is a shoe that includes the shoe sole based on the above-stated present invention, and an upper located above the shoe sole.

Advantageous Effects of Invention

According to the present invention, a shoe sole in which stability when in a standing posture and an impact absorbing performance at the time of a cutting maneuver are made compatible, and a shoe including the shoe sole, can be produced.

BRIEF DESCRIPTION OF DRAWINGS

FIG. 6 is a cross-section views of the shoe sole shown in FIG. 1.

FIG. 13 is a schematic diagrams diagram showing a shape of a groove portion in a specific region of the shoe sole shown in FIG. 1.

DESCRIPTION OF EMBODIMENTS

Figure 1:
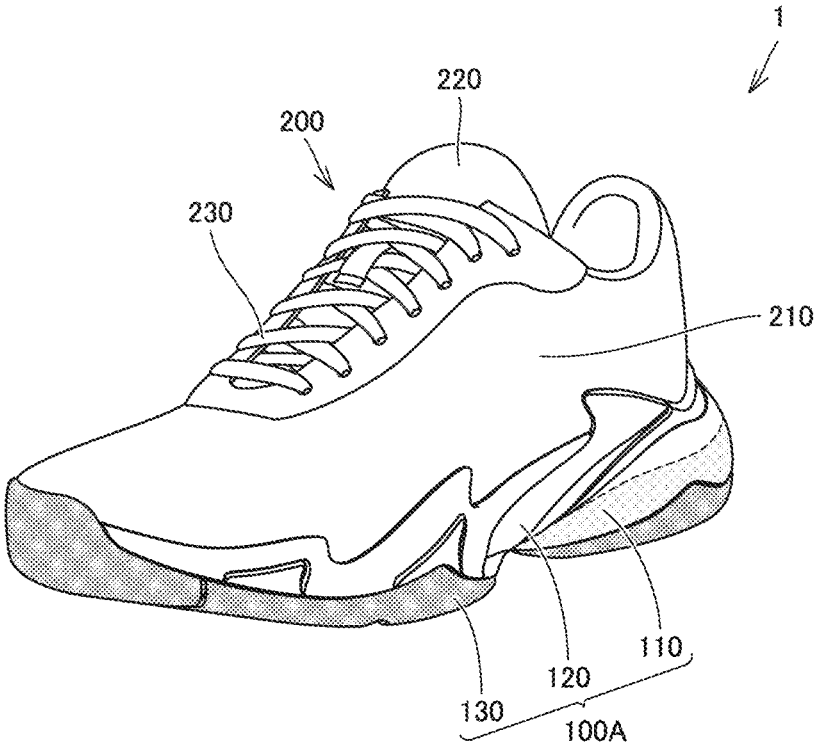
FIG. 1 is a schematic perspective view of a shoe sole and a shoe including the shoe sole relating to Embodiment 1.

Hereinafter, embodiments of the present invention will be described in detail with reference to the figures. Note that, for the embodiments shown below, same or common portions have the same reference numerals attached within the figures, and an explanation of these are not be repeated.

Embodiment 1

FIG. 1 is a schematic perspective view of a shoe sole and a shoe including the shoe sole relating to Embodiment 1. First, a schematic configuration of a shoe 1, and a shoe sole 100A included in the shoe 1, relating to the present embodiment will be described with reference to FIG. 1. Here, in FIG. 1, for ease of understanding, dark coloring is added to an outsole 130, which will be described below, and light coloring is added to portions corresponding to a first protruding portion 111 and a second protruding portion 112 (refer to FIG. 2 to FIG. 9) of a midsole 110, which will be described below (note that, this is the same for FIG. 2 to FIG. 5, FIG. 7, FIG. 9 to FIG. 11, and FIG. 14, which will be described below).

As shown in FIG. 1, the shoe 1 includes the shoe sole 100A and an upper 200. The shoe sole 100A is a member that covers a sole of a foot of a wearer, and has an approximate flat shape. The upper 200 has a bag-type shape that encloses the entire inserted foot of the wearer, and is located above the shoe sole 100A.

The upper 200 has an upper body 210, a shoe tongue 220, and a shoelace 230. The upper body 210 is a member that becomes a base of the upper 200, and has a bag-type shape. The shoe tongue 220 and the shoelace 230 are both fixed or attached to the upper body 210.

A bottom portion fixed to the shoe sole 100A is located on a lower portion of the upper body 210, and an opening portion, where an upper portion of an ankle and a part of the top of the foot are exposed, is provided on an upper portion of the upper body 210. The shoe tongue 220 is fixed, by sewing, welding, bonding, or a combination thereof, to the upper body 210 so as to cover a portion of the opening portion provided in the upper body 210 where the top part of the foot is exposed. Woven or knitted fabric, synthetic leather, resin or the like is used, for example, as the upper body 210 and the shoe tongue 220, and a double raschel warp knitted fabric with a polyester yarn knitted therein is used for a shoe that is required, in particular, to be air permeable and lightweight.

The shoelace 230 is a string-type member for pulling together peripheral edges of the opening portion, where a part of the top of the foot is exposed, provided in the upper body 210, in a foot width direction, and is passed through a plurality of hole portions provided on the peripheral edges of the opening portion. The shoelace 230 is tightened in a state where the foot of the wearer is inserted into the upper body 210, and the upper body 210 and the shoe tongue 220 can be brought into close contact with the foot.

The shoe sole 100A has a midsole 110, a reinforcing structure portion 120, and an outsole 130. The midsole 110, the reinforcing structure portion 120, and the outsole 130 are integrated with each other, thereby the shoe sole 100A has an overall approximate flat shape, such as stated above.

The outsole 130 has a ground contact surface 134 (refer to FIG. 2 to FIG. 7) on the lower surface thereof, and the midsole 110 is located above the outsole 130. Moreover, the reinforcing structure portion 120 has a part thereof embedded in the midsole 110, and another part located to be exposed from the midsole 110.

Figure 2:
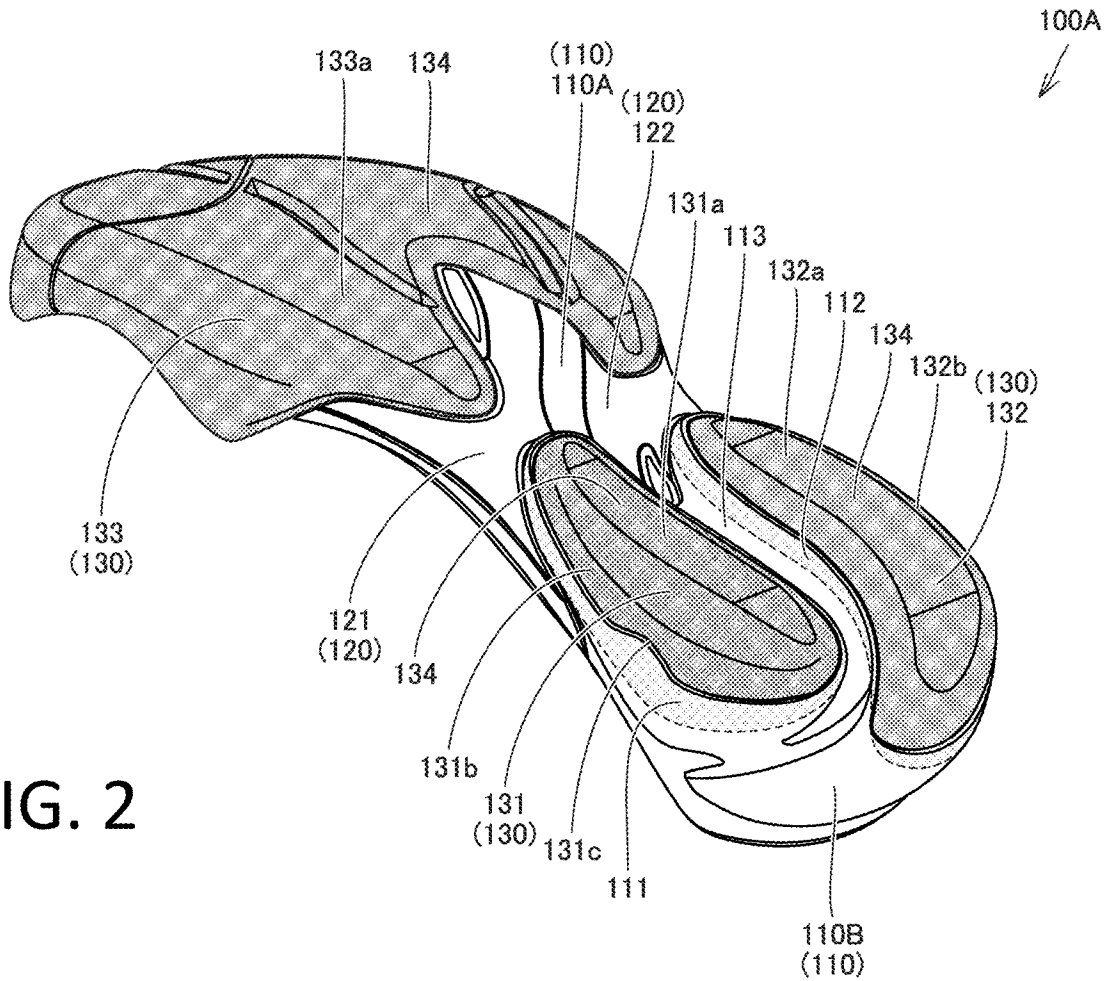
FIG. 2 is a perspective view of the shoe sole shown in FIG. 1.
Figure 3:
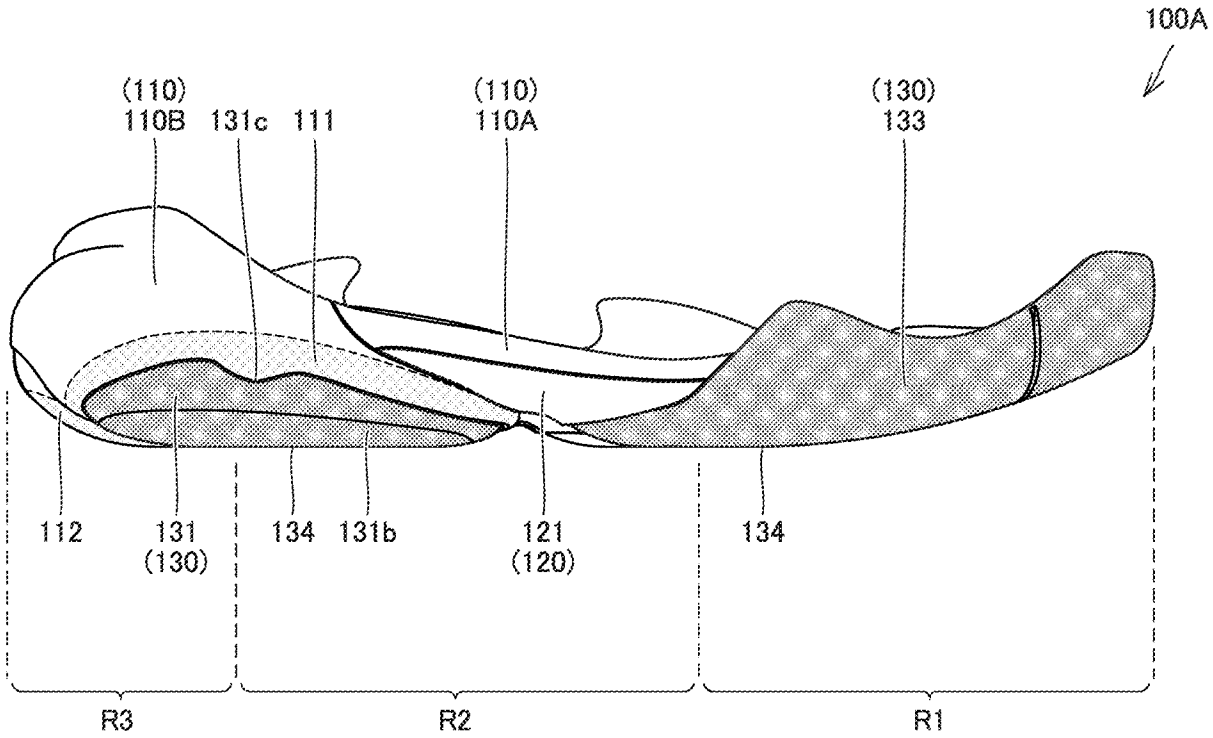
FIG. 3 is a side surface view on a medial foot side of the shoe sole shown in FIG. 1.
Figure 4:
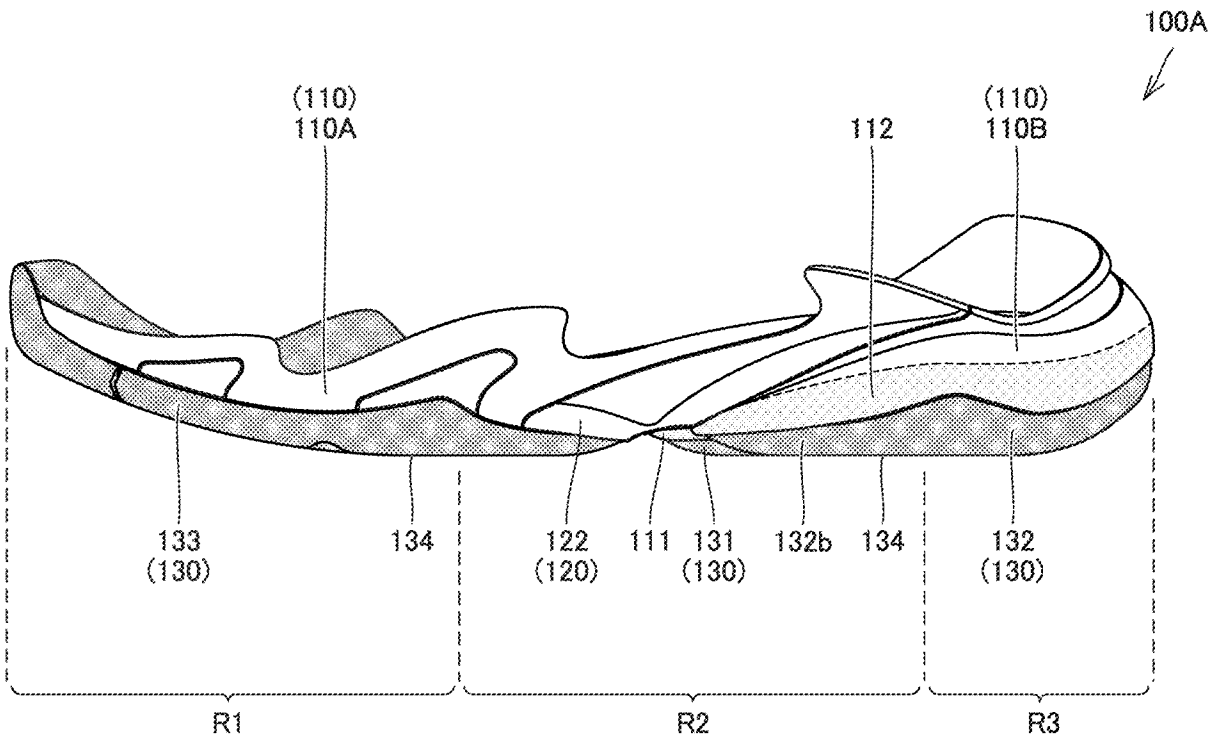
FIG. 4 is a side surface view on a lateral foot side of the shoe sole shown in FIG. 1.
Figure 5:
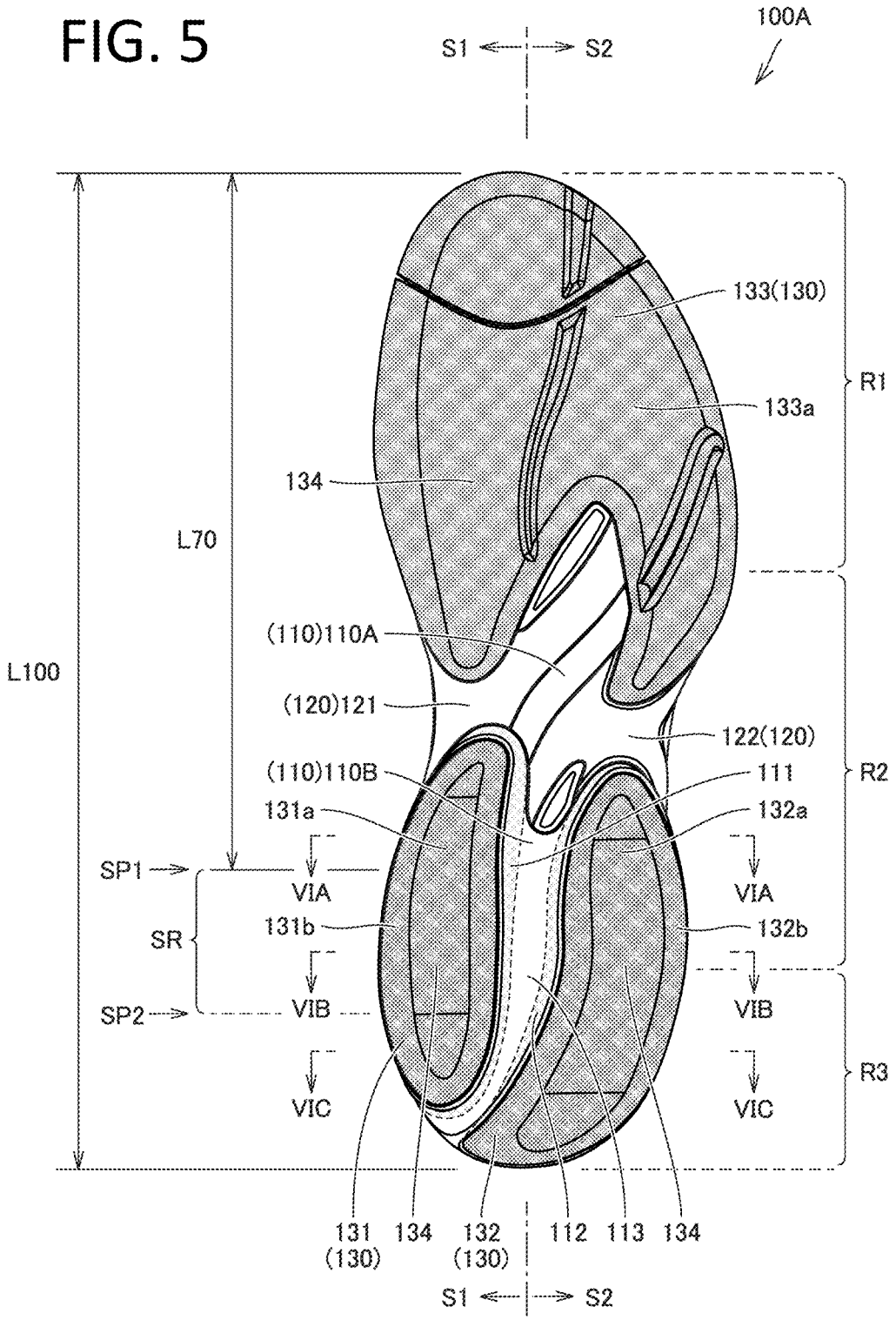
FIG. 5 is a bottom surface view of the shoe sole shown in FIG. 1.
Figure 8:
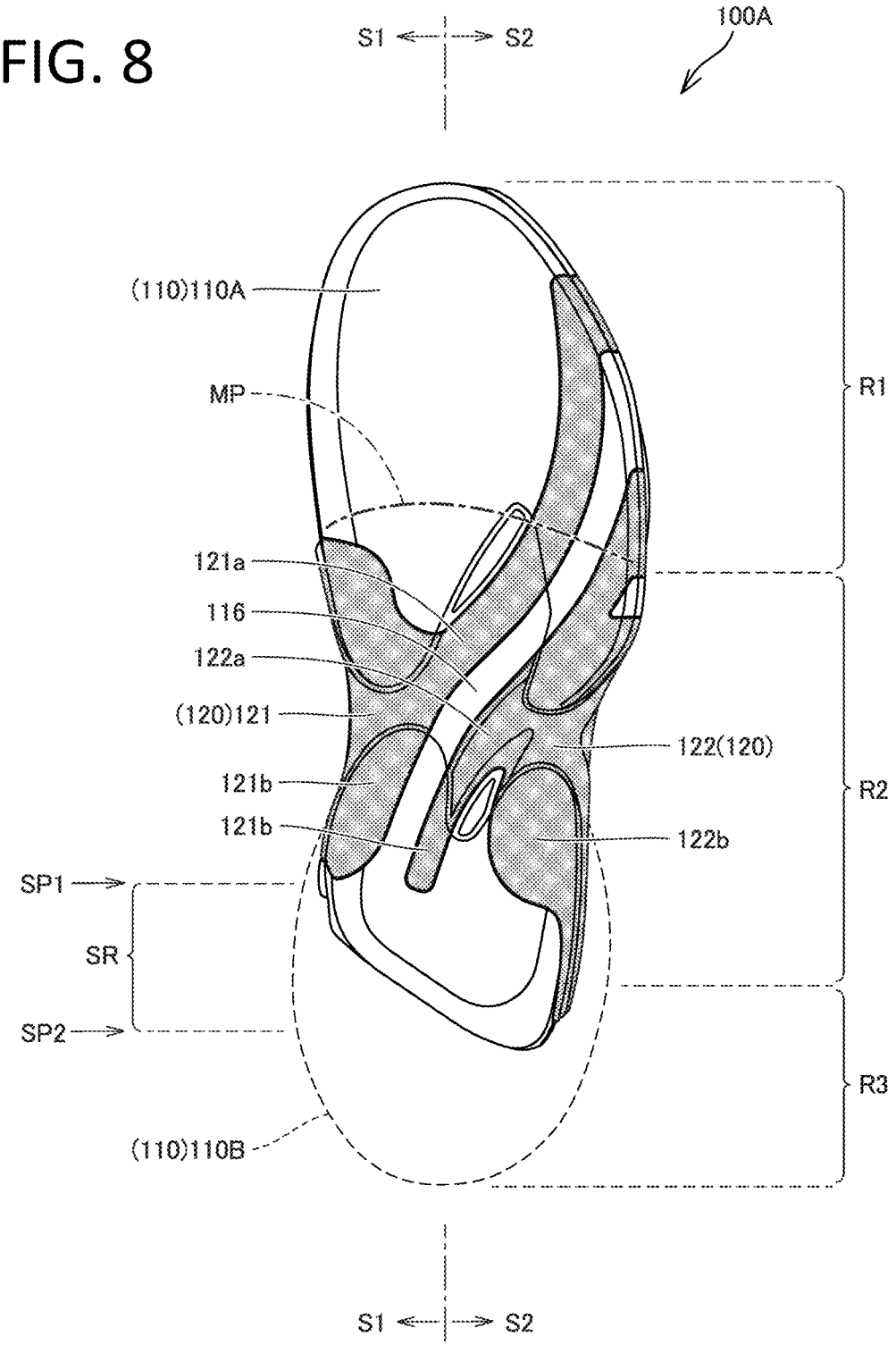
FIG. 8 is a bottom surface view showing a state where an outsole and a rear side midsole are removed from the shoe sole shown in FIG. 1.
Figure 9:
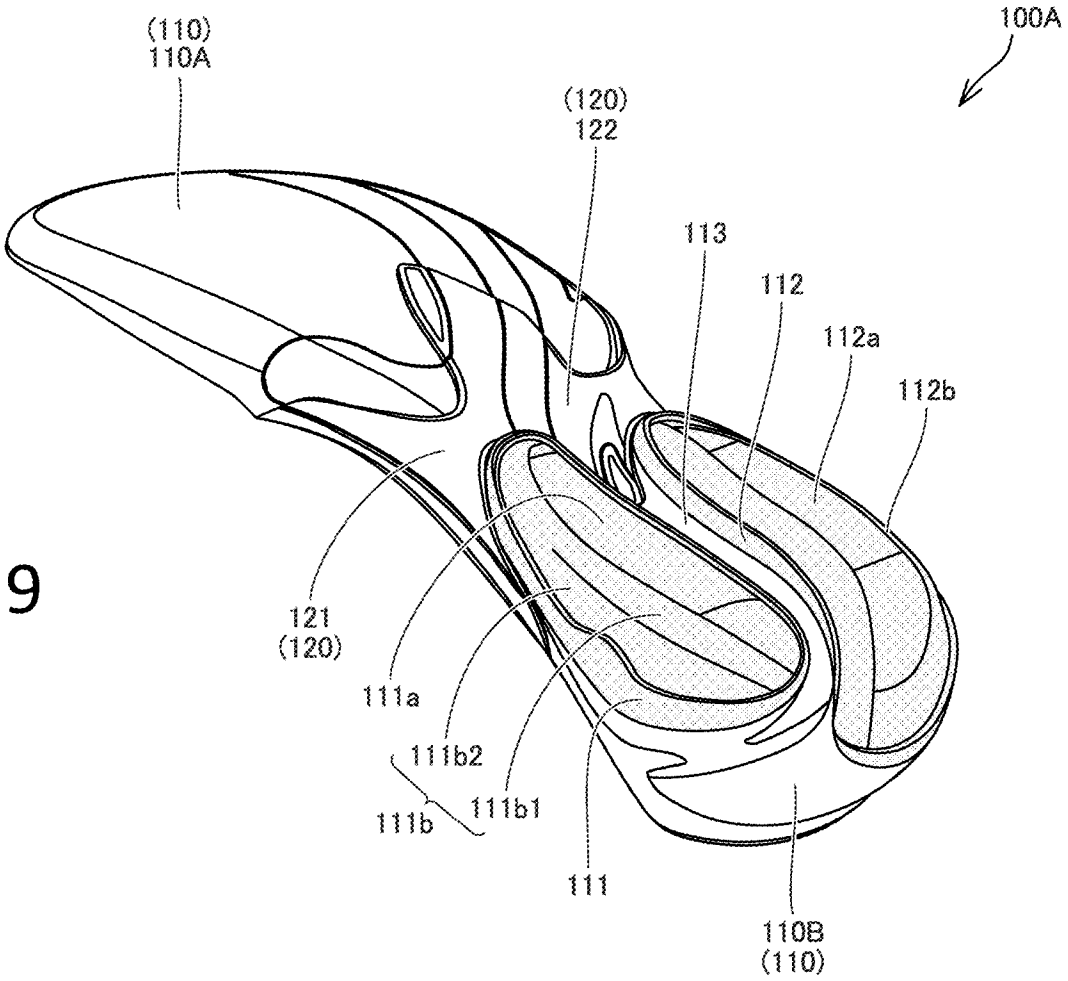
FIG. 9 is a perspective view showing a state where an outsole is removed from the shoe sole shown in FIG. 1.

FIG. 2 is a perspective view of the shoe sole shown in FIG. 1, and FIG. 3 and FIG. 4 are a side surface view on a medial foot side and a side surface view on a lateral foot side, respectively, of the shoe sole shown in FIG. 1. FIG. 5 is a bottom surface view of the shoe sole shown in FIG. 1, and FIG. 6(A) to FIG. 6(C) are cross-section views along a VIA-VIA line to a VIC-VIC line, respectively, shown in FIG. 5. FIG. 7 is an exploded perspective view of the shoe sole shown in FIG. 1, and FIG. 8 is a bottom surface view showing a state where an outsole and a rear side midsole are removed from the shoe sole shown in FIG. 1. Moreover, FIG. 9 is a perspective view showing a state where an outsole is removed from the shoe sole shown in FIG. 1. Next, a detailed structure of the shoe sole 100A relating to the present embodiment will be described with reference to FIG. 2 to FIG. 9.

As shown in FIG. 3 to FIG. 5, the shoe sole 100A is divided into a forefoot portion R1 for supporting a toe portion and a ball portion of the foot of the wearer, a midfoot portion R2 for supporting an arch portion of the foot of the wearer, and a rearfoot portion R3 for supporting a heel portion of the foot of the wearer, along a front-rear direction (left-right direction in the figures in FIG. 3 and FIG. 4, up-down direction in the figure in FIG. 5) that is a direction coinciding with a foot length direction of the foot of the wearer in a plan view state.

Here, in the case where a front side end of the shoe sole 100A is set as a reference, a location corresponding to a dimension of 40% of a dimension of the shoe sole 100A in a front-rear direction from the front side end is set as a first boundary location, and a location corresponding to a dimension of 80% of a dimension of the shoe sole 100A in the front-rear direction from the front side end is set as a second boundary location, the forefoot portion R1 corresponds to a portion included between the front side end and the first boundary location along the front-rear direction, the midfoot portion R2 corresponds to a portion included between the first boundary location and the second boundary location along the front-rear direction, and the rearfoot portion R3 corresponds to a portion included between the second boundary location and a rear side end of the shoe sole along the front-rear direction.

Moreover, as shown in FIG. 5, the shoe sole 100A is divided into a portion on a medial foot side (portion on the S1 side shown in the figure) that is a medial side of the foot in an anatomical position (namely, a side close to a midline), and a portion on a lateral foot side (portion on the S2 side shown in the figure) that is on an opposite side to the medial side of the foot in an anatomical position (namely, a side away from the midline), along a left-right direction (left-right direction in the figure) that is a direction coinciding with a foot width direction of the foot of the wearer in a plan view state.

Here, a boundary line dividing the shoe sole 100A into the portion on the medial foot side and the portion on the lateral foot side is a so-called shoe center. This shoe center, in the case where a standard wearer having a foot with a size suitable for the shoe 1 wears the shoe, is a straight line that can be obtained in the case where a straight line connecting a portion between a first toe and a second toe of the wearer and a center portion of a heel bone is projected onto the shoe sole 100A along the up-down direction. Note that, the above-stated front side end and rear side end of the shoe sole 100A are end portions of the shoe sole 100A located on this boundary line.

With reference to FIG. 2 to FIG. 7, the shoe sole 100A has the midsole 110, the reinforcing structure portion 120, and the outsole 130, such as stated above. The midsole 110 includes an upper surface, a lower surface, and a side surface connecting the upper surface and lower surface, and forms a portion of the shoe sole 100A on an upper portion side. The outsole 130 has an upper surface, and a lower surface as the ground contact surface 134 such as stated above, and forms a portion of the shoe sole 100A on a lower portion side. On the other hand, the reinforcing structure portion 120 is located so that a large portion thereof covers the lower surface of the midsole 110.

The midsole 110 is located continuously from the forefoot portion R1 to the rearfoot portion R3. The midsole 110 includes a front side midsole 110A and a rear side midsole 110B, and is formed by combining the front side midsole 110A and the rear side midsole 110B. The front side midsole 110A is located straddling across the forefoot portion R1, the midfoot portion R2, and a portion near the front end of the rearfoot portion R3, and the rear side midsole 110B is located straddling across a portion near the rear end of the midfoot portion R2, and the rearfoot portion R3.

Figure 6A:
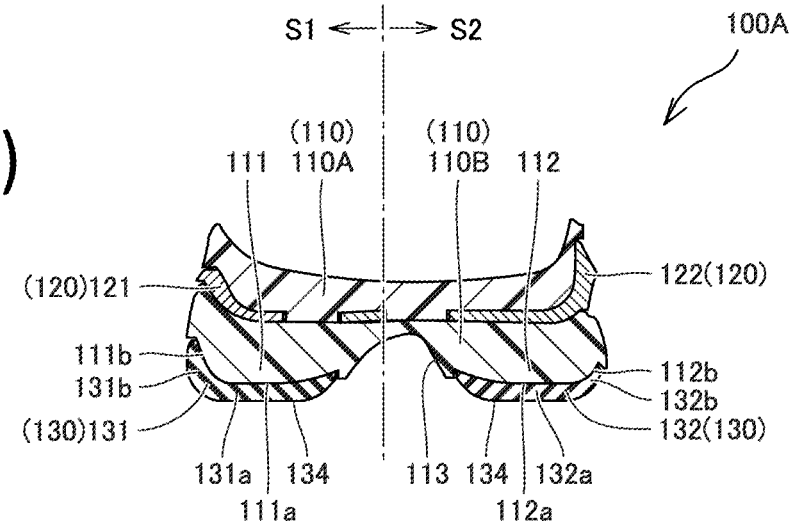
FIGS. 6 (A) to 6 (C) are
Figure 6B:
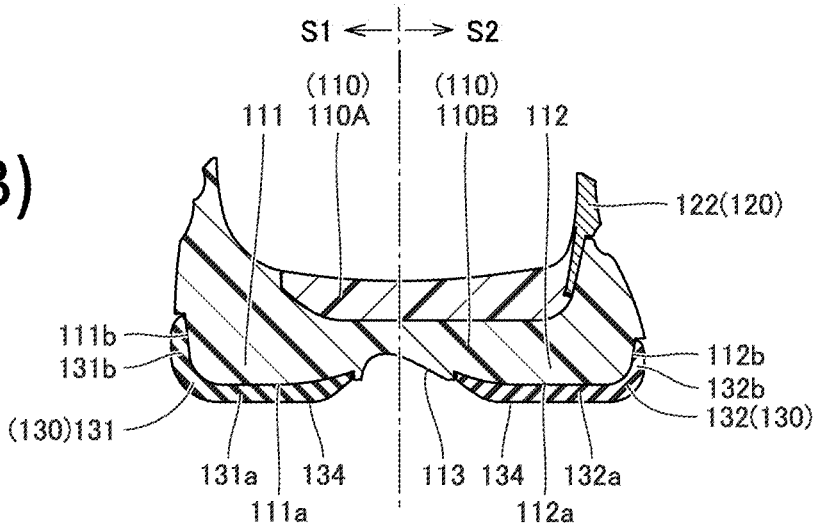
Figure 6C:
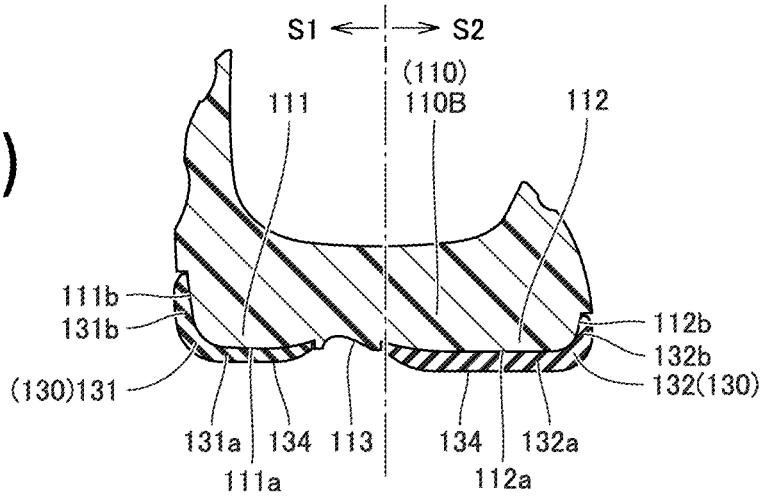
Figure 7:
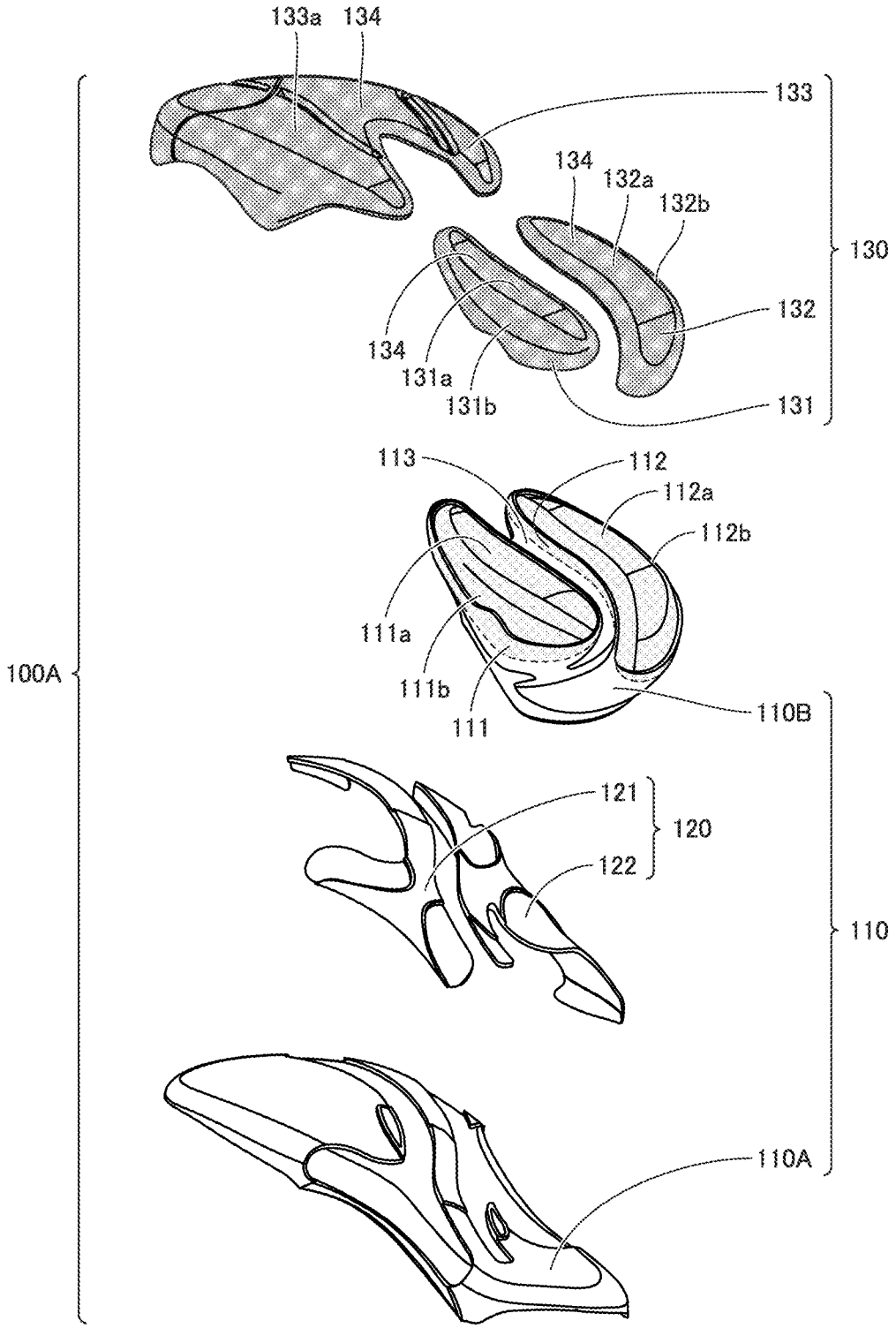
FIG. 7 is an exploded perspective view of the shoe sole shown in FIG. 1.

Here, in a portion between the portion near the rear end of the midfoot portion R2 and the portion near the front end of the rearfoot portion R3, the rear end portion of the front side midsole 110A and the front end portion of the rear side midsole 110B are overlapping in an up-down direction (namely, a direction orthogonal to both the above-stated front-rear direction and left-right direction) (in particular, refer to FIG. 6(A), FIG. 6(B), and FIG. 7). In more detail, in this portion, the front side midsole 110A and the rear side midsole 110B are overlapping, so that the front side midsole 110A is located on the upper 200 side and the rear side midsole 110B is located on the outsole 130 side.

In this way, in the forefoot portion R1 and the portion near the front end of the midfoot portion R2, the midsole 110 is formed by the front side midsole 110A, in the portion near the rear end of the midfoot portion R2 and the portion near the front end of the rearfoot portion R3, the midsole 110 is formed by the overlapping portions of the front side midsole 110A and the rear side midsole 110B, and in the portion near the rear end of the rearfoot portion R3, the midsole 110 is formed by the rear side midsole 110B.

The upper surface of the midsole 110 prescribes an upper surface of the shoe sole 100A, and the peripheral edge thereof has a protruding shape compared to the surroundings (in particular, refer to FIG. 3, FIG. 4, and FIG. 6). In this way, a concave-shaped portion is provided on the upper surface of the midsole 110, and this concave-shaped portion becomes a portion in which the upper 200 is received. The portion on the upper surface of the midsole 110, other than the peripheral edge that is a bottom surface of this concave-shaped portion, has a smooth curved surface shape so as to fit the sole of the wearer.

The outsole 130, apart from a part of the midfoot portion R2, is located continuously from roughly the forefoot portion R1 to the rearfoot portion R3. The outsole 130 includes a rear medial foot side outsole 131 as a first cover portion, a rear lateral foot side outsole 132 as a second cover portion, and a front side outsole 133 as a third cover portion.

The front side outsole 133 is located straddling across the forefoot portion R1 and the portion near the front end of the midfoot portion R2, and the rear medial foot side outsole 131 and the rear lateral foot side outsole 132 are each located straddling across the portion near the rear end of the midfoot portion R2 and the rearfoot portion R3. The rear medial foot side outsole 131 is located at a portion on the medial foot side from among the portion near the rear end of the midfoot portion R2 and the rearfoot portion R3, and the rear lateral foot side outsole 132 is located at a portion on the lateral foot side from among the portion near the rear end of the midfoot portion R2 and the rearfoot portion R3.

Since the lower surface of each of the rear medial foot side outsole 131, the rear lateral foot side outsole 132, and the front side outsole 133 (namely, the lower surface of the outsole 130) forms the ground contact surface 134 such as stated above, in order to improve the grip performance, a tread pattern may be formed by having protrusions and recesses formed on an exposed surface thereof. Each of the rear medial foot side outsole 131, the rear lateral foot side outsole 132, and the front side outsole 133 has an upper surface thereof joined to the lower surface of the midsole 110.

Note that, a detailed configuration of the portion of the midsole 110 where the outsole 130 and this portion are connected, and a specific shape of the outsole 130, will be described in detail below.

It is preferable that the midsole 110 (namely, the front side midsole 110A and the rear side midsole 110B) is excellent in a shock absorbing performance while having a suitable strength, and from this viewpoint, for example, a foam material made of resin, which includes a resin material as a main component and a foaming agent and a crosslinking agent as secondary components, is used as the midsole 110. Moreover, instead of this, a foam material made of rubber, which includes a rubber material as a main component and a plasticizer, a foaming agent, a reinforcing agent, and a crosslinking agent as secondary agents, may be used.

An ethylene-vinyl acetate copolymer (EVA), a polyolefin resin, a thermoplastic polyurethane, a thermoplastic polyamide elastomer (TPA, TPAE), or a thermoplastic polyester elastomer can be used, for example, as the resin material. Butadiene rubber can be suitably used, for example, as the rubber material.

In this way, the midsole 110 is generally formed by a member with a lower Young's modulus and more flexible than the outsole 130. Accordingly, the midsole 110 elastically deforms relatively easily in the case where receiving a compressive load. Therefore, the midsole 110 is excellent in a shock absorbing performance. Note that, various types of shock absorbing parts may be included, and reinforcing parts other than the reinforcing structure portion 120, which will be described below, may be included, at prescribed portions of the midsole 110.

It is preferable that the outsole 130 (namely, the rear medial foot side outsole 131, and the rear lateral foot side outsole 132, the front side outsole 133) is excellent in wear resistance and grip performance, and from this viewpoint, a member made of a material, which includes a rubber material as a main component and a plasticizer, a reinforcing agent, and a crosslinking agent as secondary agents, is used, for example, as the outsole 130. Butadiene rubber can be suitably used, for example, as the rubber material.

In this way, the outsole 130 is generally formed by a member with a higher Young's modulus and harder than the midsole 110. Accordingly, while the outsole 130 does not deform easily compared to the midsole 110 in the case where receiving a compressive load, it is excellent in durability such as wear resistance. Note that, the shape of the outsole 130 and the above-stated tread pattern can be appropriately designed in accordance with a usage of the shoe 1.

As shown in FIG. 2 to FIG. 9, the reinforcing structure portion 120 is disposed so that a large portion thereof is located on the midfoot portion R2, while one part thereof reaches the forefoot portion R1 and the rearfoot portion R3. The reinforcing structure portion 120 includes a medial foot side reinforcing member 121 disposed on the medial foot side and a lateral foot side reinforcing member 122 disposed on the lateral foot side.

The medial foot side reinforcing member 121 and the lateral foot side reinforcing member 122 are both connected to the lower surface and the side surface of the front side midsole 110A and the upper surface of the rear side midsole 110B. More specifically, concave portions with a shape corresponding to the medial foot side reinforcing member 121 and the lateral foot side reinforcing member 122 are provided on the lower surface and the side surface of the front side midsole 110A, and the medial foot side reinforcing member 121 and the lateral foot side reinforcing member 122 are connected to the front side midsole 110A and the rear side midsole 110B in a state where housed in these concave portions.

The medial foot side reinforcing member 121 and the lateral foot side reinforcing member 122 are both formed of a material higher in rigidity than the material forming the outsole 130. Namely, the medial foot side reinforcing member 121 and the lateral foot side reinforcing member 122 have a higher Young's modulus and are harder than the outsole 130.

While the material forming the medial foot side reinforcing member 121 and the lateral foot side reinforcing member 122 is not particularly limited, a non-fiber reinforced resin made of a polymer resin such as urethane-based thermoplastic elastomer (TPU), amide-based thermoplastic elastomer (TPA), ethylene-vinyl acetate copolymer (EVA) or the like, or a fiber reinforced resin using carbon fibers, glass fibers, aramid fibers, Dyneema fibers, Zylon fibers, boron fibers or the like as reinforcing fibers, for example, can be suitably used.

Here, as shown in FIG. 8, the medial foot side reinforcing member 121 includes a medial foot side bar portion 121*a* extending in an oblique direction so as to reach a portion near the rear end of the midfoot portion R2 on the medial foot side from a portion near the front end of the forefoot portion R1 on the lateral foot side, and the lateral foot side reinforcing member 122 includes a lateral foot side bar portion 122*a* extending in an oblique direction so as to reach a portion near the rear end of the midfoot portion R2 on the medial foot side from a portion near the rear end of the forefoot portion R1 on the lateral foot side.

The medial foot side bar portion 121*a* and the lateral foot side bar portion 122*a* are located with a distance therebetween, in particular, in the midfoot portion R2, and an interposed portion 116, which is formed by a part of the midsole 110 (more strictly, a part of the front side midsole 110A) made of a material lower in rigidity than the medial foot side reinforcing member 121 and the lateral foot side reinforcing member 122, is located between the medial foot side bar portion 121*a* and the lateral foot side bar portion 122*a*.

By being formed in such a manner, twisting easily occurs between a portion of the forefoot portion R1 on the medial foot side and a portion of the rearfoot portion R3 on the lateral foot side, around an axis in a direction where the interposed portion 116 extends, at the location where the interposed portion 116 is provided. Therefore, in association with this, an impulse of brake at the time of a cutting maneuver increases, and as a result, a swift and smooth cutting maneuver can be realized.

In addition, as shown in FIG. 8, the medial foot side bar portion 121*a* and the lateral foot side bar portion 122*a* are both provided such that a front end thereof reaches the forefoot portion R1, and the portions of the medial foot side bar portion 121*a* and the lateral foot side bar portion 122*a* located in the forefoot portion R1 both extend crossing a portion corresponding to a metatarsophalangeal joint of the foot of the wearer (the portion shown by reference character MP within the figure). In the case of being formed in such a manner, a larger propulsive force can be obtained by the resilience of the medial foot side bar portion 121*a* and the lateral foot side bar portion 122*a*, which elastically deform in accordance with dorsal flexion of the shoe sole 100A at take-off, and thereby the above-stated acceleration assisting function and travel assisting function are improved.

As shown in FIG. 7, in the shoe sole 100A relating to the present embodiment, the above-stated medial foot side reinforcing member 121 and lateral foot side reinforcing member 122 are assembled on the front side midsole 110A, prior to the front side midsole 110A and the rear side midsole 110B being combined. Accordingly, after the rear side midsole 110B is assembled with the front side midsole 110A, it becomes a state where the rear end portion of each of the medial foot side reinforcing member 121 and the lateral foot side reinforcing member 122 is sandwiched by the front side midsole 110A and the rear side midsole 110B, such as shown in FIG. 6(A) and FIG. 6(B), and these portions are embedded in the midsole 110, thereby no longer being exposed to the outside.

Note that, while the connections between each of the front side midsole 110A, the rear side midsole 110B, the medial foot side reinforcing member 121, the lateral foot side reinforcing member 122, the rear medial foot side outsole 131, the rear lateral foot side outsole 132, and the front side outsole 133 may be performed by any type of method, they can be performed, for example, by adhesion or the like.

As shown in FIG. 2 to FIG. 7 and FIG. 9, a first protruding portion 111 and a second protruding portion 112, which protrude toward the ground contact surface 134 side, are provided in the midsole 110. The first protruding portion 111 and the second protruding portion 112 are both provided at a location of the rear side midsole 110B on the lower surface side. The first protruding portion 111 is provided at a location of the shoe sole 100A on the medial foot side and on the rear end side, and the second protruding portion 112 is provided at a location of the shoe sole 100A on the lateral foot side and on the rear end side.

More specifically, the first protruding portion 111 extends along the front-rear direction of the shoe sole 100A so as to straddle across from a portion near the rear end of the midfoot portion R2 on the medial foot side to a portion near the rear end of the rearfoot portion R3 on the medial foot side, and the second protruding portion 112 extends along the front-rear direction of the shoe sole 100A so as to straddle across from a portion near the rear end of the midfoot portion R2 on the lateral foot side to a portion near the rear end of the rearfoot portion R3 on the lateral foot side. In this way, a groove portion 113, which extends along the front-rear direction of the shoe sole 100A, is located on the lower surface of the midsole 110 (more strictly, the lower surface of the rear side midsole 110B) at a portion located between the first protruding portion 111 and the second protruding portion 112.

As shown in FIG. 6, FIG. 7, and FIG. 9, the first protruding portion 111 includes a first bottom surface 111*a* located on the ground contact surface 134 side, and a first side surface 111*b* located on the medial foot side when seen from the first bottom surface 111*a*. The first bottom surface 111*a* and the first side surface 111*b* are smoothly connected. Note that, the other side surface of the first protruding portion 111, which is located on the lateral foot side when seen from the first bottom surface 111*a*, prescribes the above-stated groove portion 113.

The rear medial foot side outsole 131 as a first cover portion is assembled with the first protruding portion 111. Specifically, the rear medial foot side outsole 131 includes a first bottom wall portion 131*a* covering the first bottom surface 111*a* of the first protruding portion 111, and a first side wall portion 131*b* covering the first side surface 111*b* of the first protruding portion 111. The first bottom wall portion 131*a* prescribes the above-stated ground contact surface 134 by covering the first bottom surface 111*a*, and the first side wall portion 131*b* covers the first side surface 111*b* by being erected facing upward from a peripheral edge of the first bottom wall portion 131*a* on the medial foot side.

On the other hand, the second protruding portion 112 includes a second bottom surface 112*a* located on the ground contact surface 134 side, and a second side surface 112*b* located on the lateral foot side when seen from the second bottom surface 112*a*. The second bottom surface 112*a* and the second side surface 112*b* are smoothly connected. Note that, the other side surface of the second protruding portion 112, which is located on the medial foot side when seen from the second bottom surface 112*a*, prescribes the above-stated groove portion 113.

The rear lateral foot side outsole 132 as a second cover portion is assembled with the second protruding portion 112. Specifically, the rear lateral foot side outsole 132 includes a second bottom wall portion 132*a* covering the second bottom surface 112*a* of the second protruding portion 112, and a second side wall portion 132*b* covering the second side surface 112*b* of the second protruding portion 112. The second bottom wall portion 132*a* prescribes the above-stated ground contact surface 134 by covering the second bottom surface 112*a*, and the second side wall portion 132*b* covers the second side surface 112*b* by being erected facing upward from a peripheral edge of the second bottom wall portion 132*a* on the lateral foot side.

Here, the ground contact surface 134 prescribed by the first bottom wall portion 131*a* and the second bottom wall portion 132*a* is a portion in contact with the ground surface when in a standing posture, which is a state where the wearer is standing on a flat ground surface, and specifically, the portion shown with hatched lines in FIG. 10 and FIG. 12, which will be described below, corresponds to this surface. In the first bottom wall portion 131*a* and the second bottom wall portion 132*a*, only the portion with hatched lines corresponds to this surface (namely, only the portion in contact with a flat ground surface when in a standing posture corresponds to this surface), and the portion without hatched lines (namely, the portion not in contact with a flat ground surface when in a standing posture) is not included in this surface.

Note that, the front side outsole 133 as a third cover portion is connected to the lower surface of the front side midsole 110A. The front side outsole 133 is located straddling across the forefoot portion R1 and a portion near the front end of the midfoot portion R2, and includes a third bottom wall portion 133*a* covering the lower surface of the front side midsole 110A at this portion. Moreover, the front side outsole 133 has a third side wall portion erected from a peripheral edge of the third bottom wall portion 133*a*, and the third side wall portion covers the side surface of the front side midsole 110A.

The shoe 1 and the shoe sole 100A included in the shoe 1 relating to the present embodiment focus on the fact that, in the case where the wearer performs a cutting maneuver, a portion in contact with the ground surface in an initial stage when landing thereof is a portion of the shoe sole on the rear medial foot side, and are applied with improvements to increase a shock absorbing performance in this portion.

Namely, at the time of a cutting maneuver, there are many cases where landing is performed in a state where the entire shoe is inclined to the medial foot side and the forefoot portion is raised above the rearfoot portion (namely, a state where the foot of the wearer inclines to the inside and the toe portion (tiptoe) is raised above the heel portion), and in this case, as stated above, a portion of the shoe sole on the rear medial foot side in an initial stage of landing contacts the ground, and afterwards, the entire ground contact surface of the shoe sole lands.

Accordingly, in the shoe 1 and the shoe sole 100A included in the shoe 1 relating to the present embodiment, the deformability of the portion of the shoe sole 100A on the rear medial foot side increases, by providing the first protruding portion 111 and the second protruding portion 112, which protrude toward the ground contact surface 134 side, such as stated above, in a state where divided into a medial foot side and a lateral foot side at a portion of the midsole 110 on the rear end side (in other words, by providing the groove portion 113, which extends along the front-rear direction of the shoe sole 100A, at a portion of the midsole 110 on the rear end side), and as a result of this, a shock absorbing performance at the time of a cutting maneuver improves.

Namely, in the shoe 1 and the shoe sole 100A included in the shoe 1 relating to the present embodiment, in an initial stage of a cutting maneuver, the portion of the shoe sole 100A where the first protruding portion 111 is provided contacts the ground prior to the other portions, and the first protruding portion 111 swiftly and significantly deforms without being affected by the other portions of the midsole 110. Therefore, an impact transmitted to the wearer is absorbed by the deformation of the first protruding portion 111, and as a result, a large shock absorbing performance can be obtained.

In addition, in the shoe 1 and the shoe sole 100A included in the shoe 1 relating to the present embodiment, a contrivance is applied to the shape of a peripheral edge of the shoe sole 100A on the medial foot side at the portion where the first protruding portion 111 is provided (more specifically, the shape of a portion corresponding to a specific region SR (refer to FIG. 10 to FIG. 12), which will be described below, of a peripheral edge). Therefore, an improvement of a shock absorbing performance and stability when in a standing posture are made compatible. Hereinafter, this point will be described in detail.

Figure 10A:
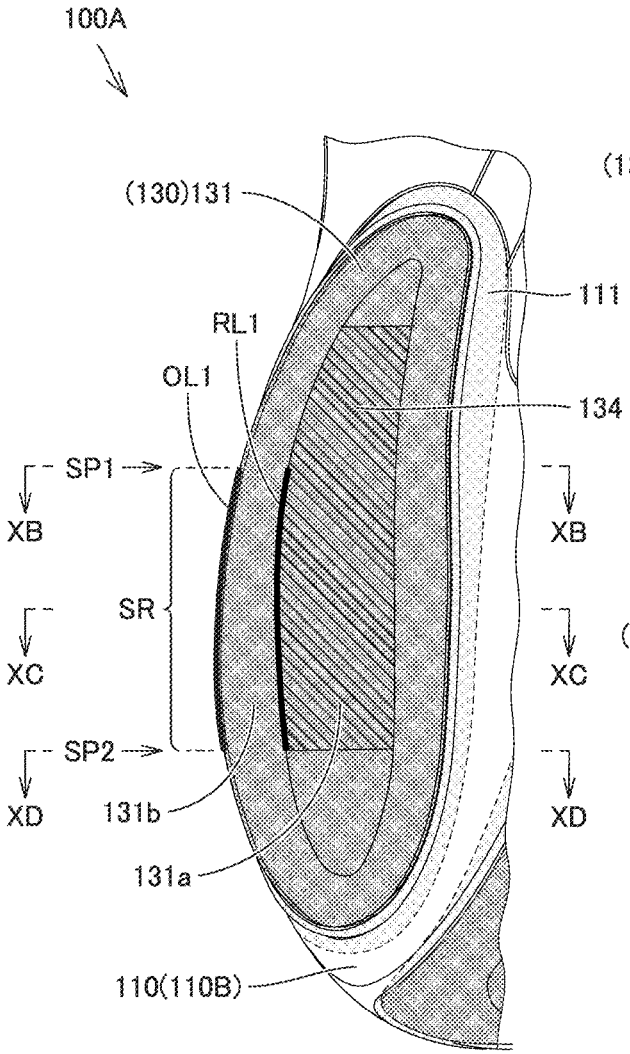
FIG. 10(A) is an enlarged bottom surface view and FIGS. 10(B) to 10(D) are partial cross-section views of a portion that includes a specific region of the shoe sole shown in FIG. 1.

FIG. 10(A) is an enlarged bottom surface view of a portion that includes a specific region of the shoe sole shown in FIG. 1, and FIG. 10(B) to FIG. 10(D) are partial cross-section views along an XB-XB line to an XD-XD line, respectively, shown in FIG. 10(A). FIG. 11(A) is an enlarged side surface view on the medial foot side of a portion that includes a specific region of the shoe sole shown in FIG. 1, and FIG. 11(B) to FIG. 11(D) are partial cross-section views along an XIB-XIB line to an XID-XID line, respectively, shown in FIG. 11(A). Moreover, FIG. 12 is a schematic view showing a shape of an outsole of the shoe sole shown in FIG. 1.

Figure 11A:
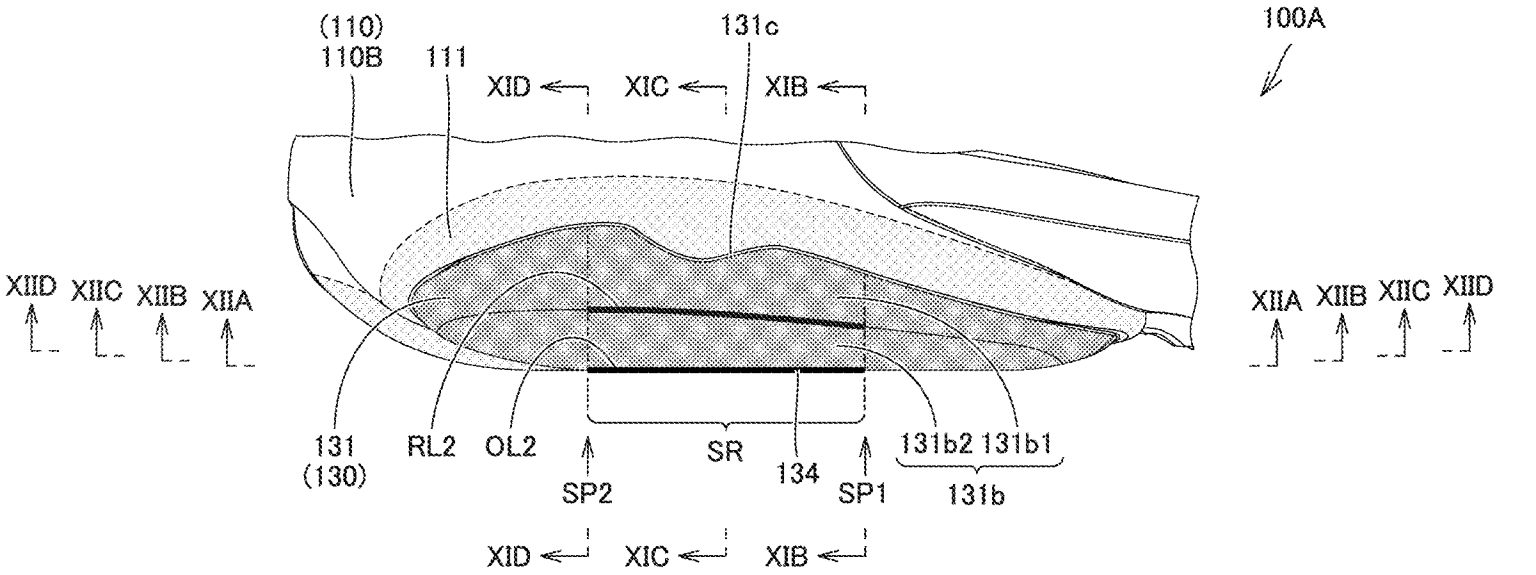
FIG. 11(A) is an enlarged side surface view and FIGS. 11(B) to 11(D) are partial cross-section views on a medial foot side of a portion that includes a specific region of the shoe sole shown in FIG. 1.
Figure 11B:
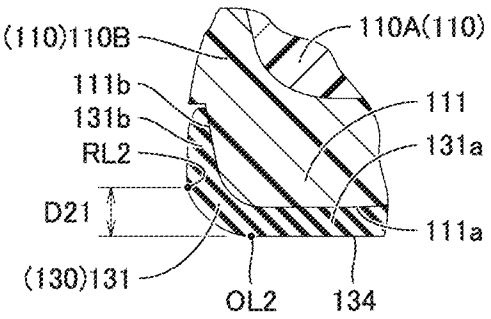
Figure 11C:
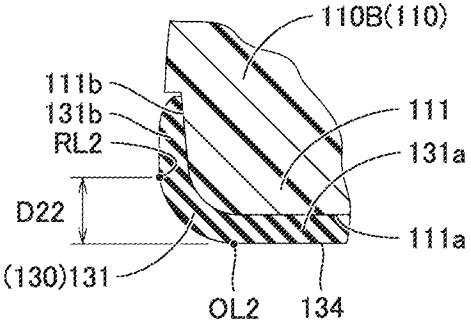
Figure 11D:
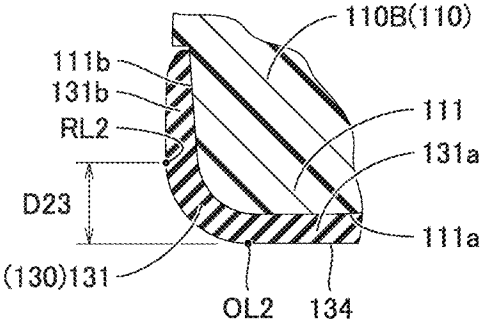
Figure 12:
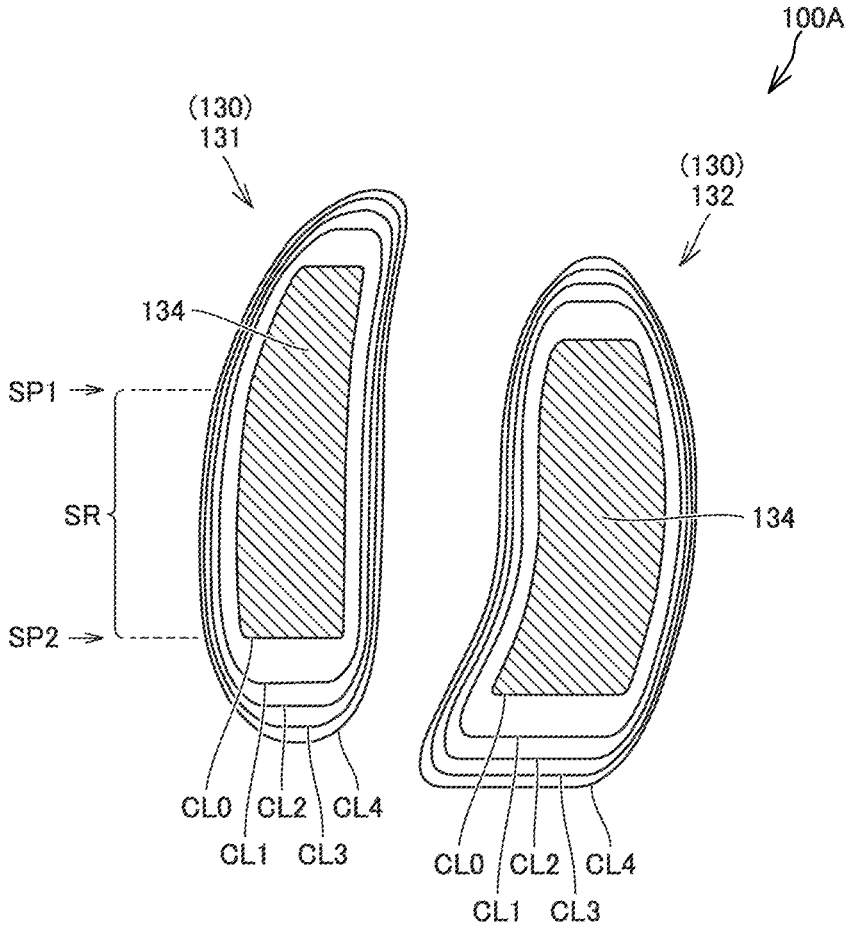
FIG. 12 is a schematic diagram showing a shape of an outsole of the shoe sole shown in FIG. 1.

As shown in FIG. 10 to FIG. 12, the specific region SR is a region across a prescribed width of the shoe sole 100A in the front-rear direction, a location of a front side thereof is specified by a front side specific location SP1, and a location of a rear end thereof is specified by a rear side specific location SP2. The specific region SR includes a portion near the rear end of the midfoot portion R2 and a portion near the front end of the rearfoot portion R3.

Specifically, with reference to FIG. 5, the front side specific location SP1 has a front side end of the shoe sole 100A in the front-rear direction that is set as a reference, and is a location corresponding to a dimension of 70% (a distance L70 shown in the figure corresponds to this dimension) of a dimension from the front side end to a rear side end of the shoe sole 100A in the front-rear direction (a distance L100 shown in the figure corresponds to this dimension).

On the other hand, the rear side specific location SP2 is a location corresponding to a location of the first bottom wall portion 131*a* on the rear end side of the rear medial foot side outsole 131 as a first cover portion (namely, the above-stated rear end location of the ground contact surface 134 when in a standing posture provided in the rear medial foot side outsole 131).

The specific region SR located between the front side specific location SP1 and the rear side specific location SP2 is a region that includes the above-stated portion in contact with the ground surface in an initial stage at the time of a cutting maneuver, and more specifically, an end portion of the specific region SR on the medial foot side alone contacts the ground in an initial stage at the time of a cutting maneuver.

As shown in FIG. 10(A) to FIG. 10(D), in the shoe sole 100A, a first ridgeline RL1 of the rear medial foot side outsole 131 located at a boundary between the first bottom wall portion 131*a* and the first side wall portion 131*b* is located so as to separate from a first outline OL1 of the rear medial foot side outsole 131 prescribed by the first side wall portion 131*b* from the front side specific location SP1 toward the rear side specific location SP2, in the case where seen along a normal direction of the ground contact surface 134.

Figure 10B:
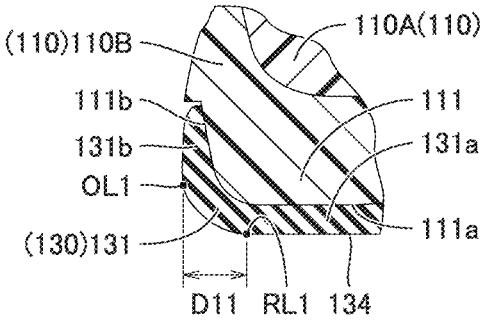
Figure 10C:
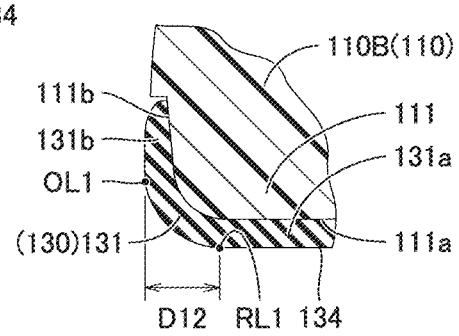
Figure 10D:
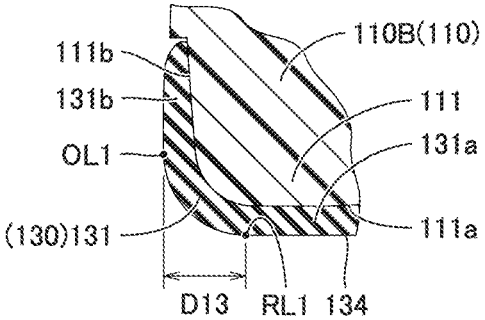

In other words, in the above-stated specific region SR, a distance between the first ridgeline RL1 and the first outline OL1 (distances D11 to D13 shown in FIG. 10(B) to FIG. 10(D) correspond to this distance) increases toward the rear side. Namely, the distances D11 to D13 satisfy the condition of D11<D12<D13.

Here, the first bottom wall portion 131*a* and the first side wall portion 131*b* are formed continuously with each other. Therefore, by satisfying the above-stated condition, a portion of the first side wall portion 131*b* located between the first ridgeline RL1 and the first outline OL1 has a size that increases toward the rear side. Since the portion of the first side wall portion 131*b* located between the first ridgeline RL1 and the first outline OL1 is the above-stated portion that contacts the ground prior to the other portions in an initial stage of a cutting maneuver, an area of this portion increases. Therefore, a load added to the shoe sole 100A when contacting the ground is dispersed, and as a result, a shock absorbing performance increases.

On the other hand, in the case where an area of the portion corresponding to the specific region SR, from within the portion of the first side wall portion 131*b* located between the first ridgeline RL1 and the first outline OL1, increases overall, an area of the ground contact surface 134 naturally reduces only by this amount. Therefore, there is the risk of losing stability when in a standing posture.

Accordingly, as in the present embodiment, in the above-stated specific region SR, by having the portion of the first side wall portion 131*b* located between the first ridgeline RL1 and the first outline OL1 increase toward the rear side, not only does an impact absorbing performance improve at the time of a cutting maneuver, but stability when in a standing posture can be sufficiently secured. Therefore, by having the shoe 1 and the shoe sole 100A included in the shoe 1 relating to the present embodiment, a shoe sole in which stability when in a standing posture and an impact absorbing performance at the time of a cutting maneuver are made compatible, and a shoe including the shoe sole, can be produced.

Note that, the shoe sole 100A relating to the present embodiment satisfies the following several conditions, in addition to the above condition.

First, as shown in FIG. 9, in the shoe sole 100A, the first side surface 111*b* of the first protruding portion 111 of the midsole 110 includes an upper side surface 111*b*1 substantially orthogonal to the ground contact surface 134, and a lower side surface 111*b*2 for smoothly connecting the first bottom surface 111*a* and the upper side surface 111*b*1, and as shown in FIG. 11(A), the first side wall portion 131*b* of the rear medial foot side outsole 131 includes an upper side first side wall portion 131*b*1 covering the upper side surface 111*b*1, and a lower side first side wall portion 131*b*2 covering the lower side surface 111*b*2.

Also, as shown in FIG. 11(A) to FIG. 11(D), in the shoe sole 100A, a second ridgeline RL2 of the rear medial foot side outsole 131 located at a boundary between the upper side first side wall portion 131*b*1 and the lower side first side wall portion 131*b*2 is located so as to separate from a second outline OL2 of the rear medial foot side outsole 131 prescribed by the first bottom wall portion 131*a* from the front side specific location SP1 toward the rear side specific location SP2, in the case where seen along the left-right direction of the shoe sole 100A.

In other words, in the above-stated specific region SR, a distance between the second ridgeline RL2 and the second outline OL2 (distances D21 to D23 shown in FIG. 11(B) to FIG. 11(D) correspond to this distance) increases toward the rear side. Namely, the distances D21 to D23 satisfy the condition of D21<D22<D23.

By satisfying this condition, the lower side first side wall portion 131*b*2, which is a portion of the first side wall portion 131*b* located between the second ridgeline RL2 and the second outline OL2, has a size that increases toward the rear side. The lower side first side wall portion 131*b*2 located between the second ridgeline RL2 and the second outline OL2 is a portion that contacts the ground prior to the other portions in an initial stage of a cutting maneuver. Therefore, by satisfying this condition, an impact absorbing performance at the time of a cutting maneuver improves.

Next, as shown in FIG. 10 and FIG. 11, in the shoe sole 100A, a radius of curvature of the surface of the above-stated portion of the first side wall portion 131*b* located between the first ridgeline RL1 and the first outline OL1 (namely, the above-stated lower side first side wall portion 131*b*2 located between the second ridgeline RL2 and the second outline OL2) is formed so as to gradually increase from the front side specific location SP1 toward the rear side specific location SP2.

By satisfying this condition, not only does it become possible to ensure compatibility between stability when in a standing posture and an impact absorbing performance at the time of a cutting maneuver, but also the portion of the first side wall portion 131*b* located between the first ridgeline RL1 and the first outline OL1 has a smooth shape. Therefore, it is excellent in design.

In addition, with reference to FIG. 12, the shoe sole 100A satisfies a specific condition, in the case where drawing a portion of the ground contact surface 134 included in the specific region SR, and a contour line of the outsole 130 of the case where cut along an XIIA-XIIA line to an XIID-XIID line shown in FIG. 11, in an overlapping manner. Here, in FIG. 12, a curved line CL0 represents a contour line of the ground contact surface 134, and curved lines CL1 to CL4 represent contour lines of cross-sections of the rear medial foot side outsole 131 and the rear lateral foot side outsole 132 at locations separated distances of 1 mm, 2 mm, 3 mm, and 4 mm, respectively, on an upper side from the ground contact surface 134. Namely, the curved lines CL0 to CL4 are so-called contours.

In the shoe sole 100A, in the case where drawing a figure such as shown in FIG. 12, a condition is satisfied in which portions of the curved lines CL1 to CL4 corresponding to the medial foot side of the rear medial foot side outsole 131 separate from the curved line CL0 from the front side specific location SP1 toward the rear side specific location SP2. This condition is not satisfied in any of a portion corresponding to the lateral foot side of the rear medial foot side outsole 131, a portion corresponding to the medial foot side of the rear lateral foot side outsole 132, and a portion corresponding to the lateral foot side of the rear lateral foot side outsole 132, and is satisfied only limited to a portion corresponding to the medial foot side of the rear medial foot side outsole 131.

The portions of the curved lines CL0 to CL4 corresponding to the medial foot side of the rear medial foot side outsole 131 correspond to the above-stated portion that contacts the ground prior to the other portions of the shoe sole 100A in an initial stage of a cutting maneuver. Therefore, by having the portions of the curved lines CL0 to CL4 satisfy this condition, an impact absorbing performance at the time of a cutting maneuver improves.

Therefore, by satisfying at least one of the above-stated conditions, a shoe sole in which stability when in a standing posture and an impact absorbing performance at the time of a cutting maneuver are made compatible, and a shoe including the shoe sole, can be produced.

Here, in the shoe 1 and the shoe sole 100A including the shoe 1 relating to the present embodiment, further contrivances are applied to each portion, in order to improve an impact absorbing performance at the time of a cutting maneuver. Hereinafter, these contrivances will be described.

First, as shown in FIG. 2, FIG. 3, and FIG. 11, in the shoe sole 100A, a constricted portion 131*c* is provided on an upper end portion of the first side wall portion 131*b* of the rear medial foot side outsole 131. This constricted portion 131*c* is formed by providing a notch on the upper end portion of the first side wall portion 131*b*, and in the portion where the constricted portion 131*c* is provided, the upper end of the first side wall portion 131*b* of the rear medial foot side outsole 131 is located on the ground contact surface 134 side compared to the surroundings.

In the case of being formed in such a manner, since it becomes possible to deform so that the rear medial foot side outsole 131 curves in the front-rear direction, with the portion where the constricted portion 131*c* is provided as a base point, it becomes possible to increase the deformability of the portion of the shoe sole 100A on the rear medial foot side, and as a result of this, a shock absorbing performance at the time of a cutting maneuver further improves.

Figure 13A:
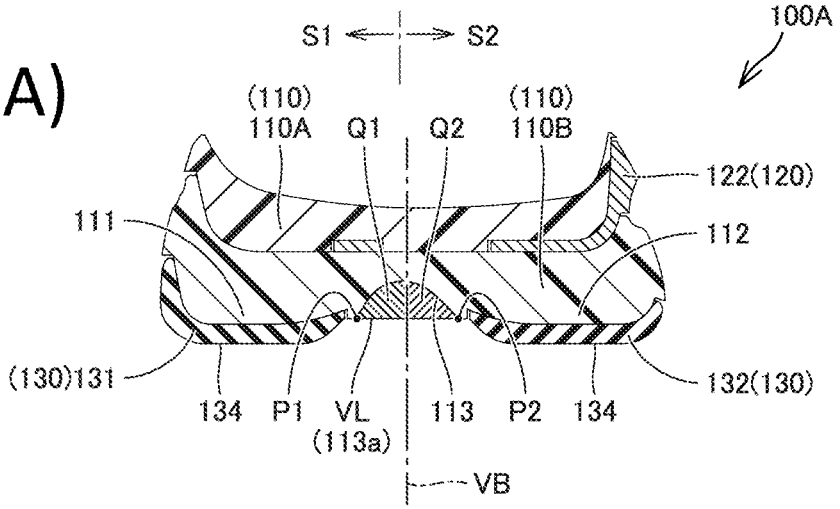
FIGS. 13(A) to 13(C) are
Figure 13B:
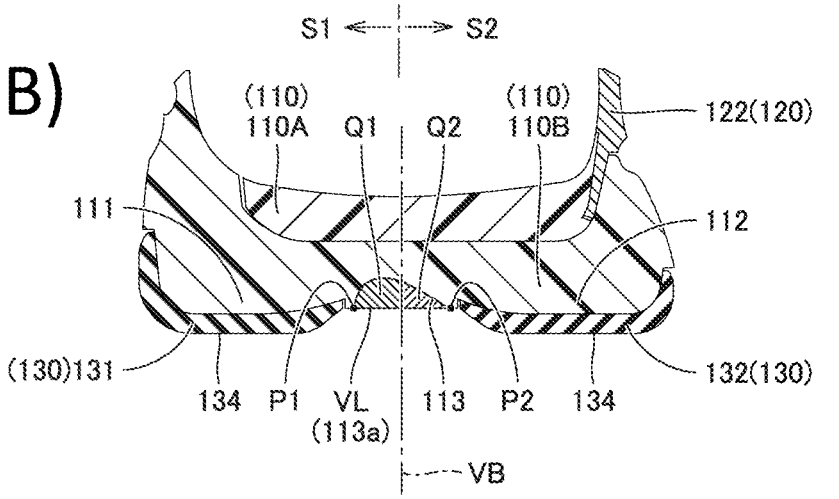
Figure 13C:
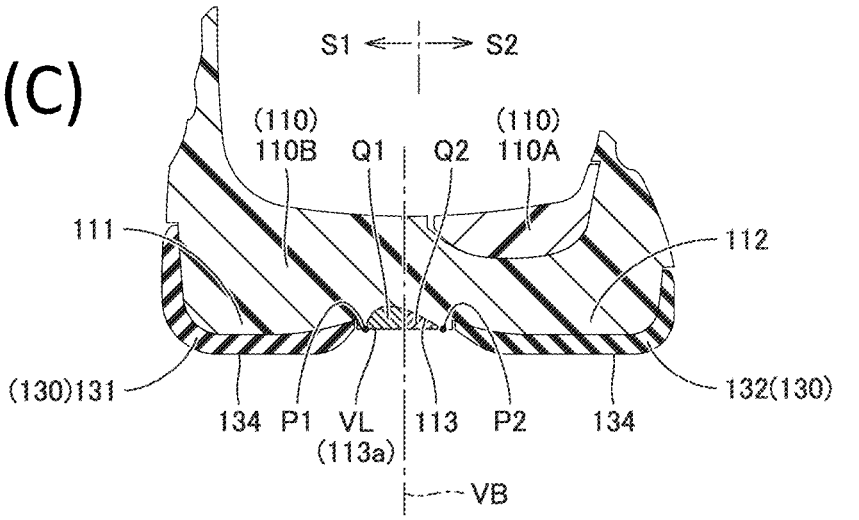

Moreover, as shown in FIG. 13, in the shoe sole 100A, a contrivance is applied for the shape of the groove portion 113 of the midsole 110 provided between the first protruding portion 111 and the second protruding portion 112. FIG. 13(A) to FIG. 13(C) are cross-section views of the entire shoe sole at the same locations as the cross-sections shown in FIG. 10(B) to FIG. 10(D), respectively.

As shown in FIG. 2 and FIG. 5 to FIG. 7, the groove portion 113 formed between the first protruding portion 111 and the second protruding portion 112 includes a portion extending along the front-rear direction of the shoe sole 100A, such as stated above. By providing the groove portion 113 at a portion of the midsole 110 on the rear end side, such as stated above, this groove portion 113 increases the deformability of the portion of the shoe sole 100A on the rear medial foot side, and as a result of this, a shock absorbing performance at the time of a cutting maneuver improves.

Here, as shown in FIG. 13(A) to FIG. 13(B), in the shoe sole 100A, in the case where the shoe sole 100A is cut along a surface orthogonal to the front rear-direction of the shoe sole 100A at an arbitrary location from the front side specific location SP1 to the rear side specific location SP2, and in this cross-section, drawing a virtual line VL connecting end points P1 and P2 of the midsole 110 prescribing an opening surface 113*a* of the groove portion 113 and a vertical bisector line VB of this virtual line VL, an area Q1 surrounded by the virtual line VL, the vertical bisector line VB, and a portion of a contour line of the groove portion 113 on the medial foot side is formed to be larger than an area Q2 surrounded by the virtual line VL, the vertical bisector line VB, and a portion of a contour line of the groove portion 113 on the lateral foot side.

In the case of being formed in such a manner, since the side surface located on an opposite side to the first side surface 111*b* of the first protruding portion 111 (namely, the above-stated side surface of the first protruding portion 111 on the lateral foot side prescribed by the groove portion 113) has a generally steeper gradient, the first protruding portion 111 easily deforms with a portion on the base side of the first protruding portion 111 as a base point. Accordingly, by being formed in such a manner, it becomes possible to increase the deformability of the portion of the shoe sole 100A on the rear medial foot side, and as a result of this, a shock absorbing performance at the time of a cutting maneuver further improves.

In addition, as shown in FIG. 7 and FIG. 8, in the shoe sole 100A, the midsole 110 is divided into the front side midsole 110A and the rear side midsole 110B, the midsole 110 is formed by having these portions overlap each other, and in accordance with this, in the portion where the front side midsole 110A and the rear side midsole 110B overlap, rear end portions 121*b* and 122*b* of each of the medial foot side reinforcing member 121 and the lateral foot side reinforcing member 122 are embedded in the midsole 110 by being sandwiched by the front side midsole 110A and the rear side midsole 110B.

In the case of being formed in such a manner, since the members in this portion are disposed from the ground contact surface 134 in the order of the outsole 130 (the rear medial foot side outsole 131 or the rear lateral foot side outsole 132), the midsole 110 (the rear side midsole 110B), the reinforcing structure portion 120 (the medial foot side reinforcing member 121 or the lateral foot side reinforcing member 122), and the midsole 110 (front side midsole 110A), the midsole 110 is located directly on the outsole 130, without interposing the reinforcing structure portion 120. Therefore, a shock absorbing function is maximized.

Note that, in the shoe 1 and the shoe sole 100A included in the shoe 1 relating to the present embodiment, since the outsole 130 assembled with a portion of the midsole 110 on the rear end side is formed by being divided into the rear medial foot side outsole 131 as a first cover portion and the rear lateral foot side outsole 132 as a second cover portion (namely, as different members in which a first cover portion and a second cover portion are separated from each other), they may be formed of different materials.

In this case, if the rear medial foot side outsole 131 as a first cover portion is made of a material lower in rigidity than the material forming the rear lateral foot side outsole 132 as a second cover portion, it becomes possible to increase the deformability of the portion of the shoe sole 100A on the rear medial foot side, and as a result of this, a shock absorbing performance at the time of a cutting maneuver further improves.

Moreover, in the shoe 1 and the shoe sole 100A included in the shoe 1 relating to the present embodiment, the first protruding portion 111 provided in the midsole 110 and the rear medial foot side outsole 131 as a first cover portion are both provided on the medial foot side from a center location of the shoe sole 100A in the left-right direction. If formed in such a manner, a shock absorbing performance at the time of a cutting maneuver more certainly improves.

Figure 14A:
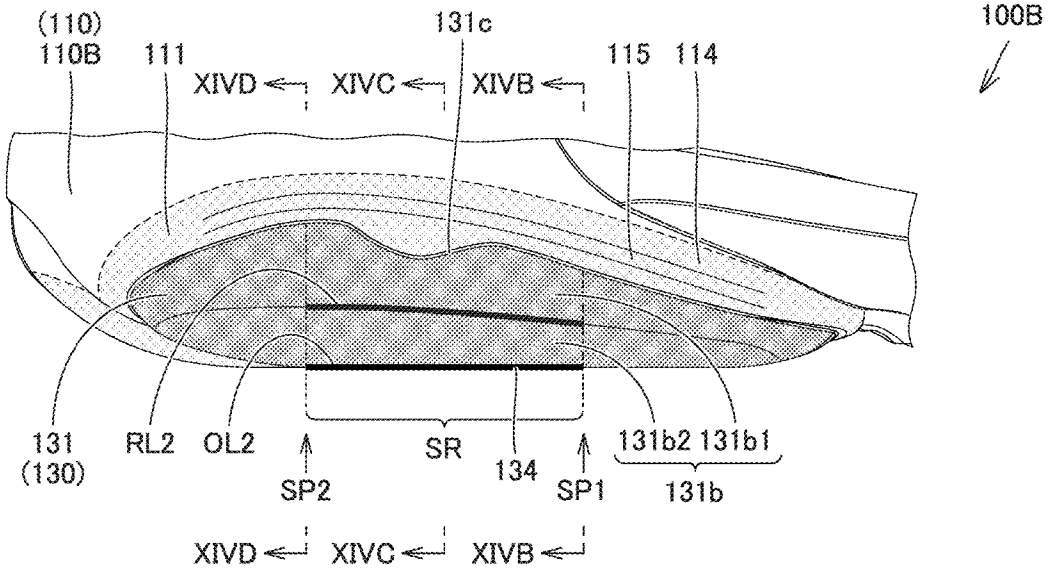
FIG. 14 (A) is an enlarged side surface view and FIGS. 14(B) to 14(D) are partial cross-section views on a medial foot side of a portion that includes a specific region of a shoe sole relating to Embodiment 2.
Figure 14B:
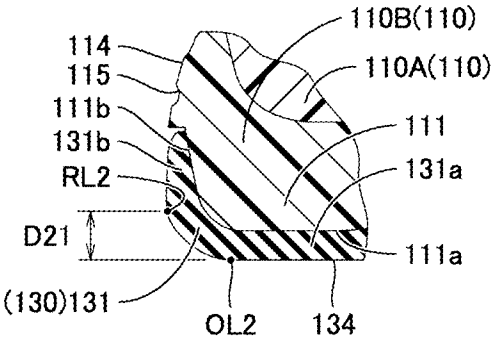
Figure 14C:
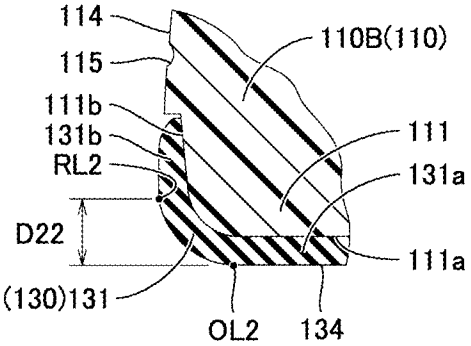
Figure 14D:
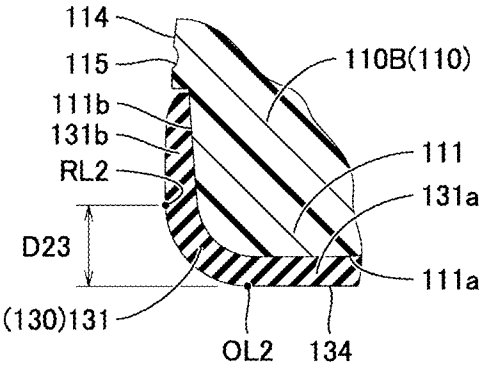

(Embodiment 2) FIG. 14(A) is an enlarged side surface view on the medial foot side of a portion that includes a specific region of a shoe sole relating to Embodiment 2, and FIG. 14(B) to FIG. 14(D) are partial cross-section views along an XIVB-XIVB line to an XIVD-XIVD line, respectively, shown in FIG. 14(A). Hereinafter, a shoe sole 100B relating to the present embodiment will be described with reference to FIG. 14. Note that, the shoe sole 100B relating to the present embodiment is included in the shoe 1, instead of the shoe sole 100A relating to the above-stated Embodiment 1.

As shown in FIG. 14, the shoe sole 100B relating to the present embodiment, in the case where compared with the shoe sole 100A relating to the above-stated Embodiment 1, has a configuration that is different only for the point of a concave portion 115 is provided at a prescribed location of the midsole 110.

Specifically, with reference to FIG. 14, the concave portion 115 is formed on an outside exposed surface 114 of the midsole 110. This outside exposed surface 114 is a portion, from within the midsole 110, adjacent to an upper end portion of the first side wall portion 131*b* of the rear medial foot side outsole 131 as a first cover portion, and exposed above the first side wall portion 131*b*, and the concave portion 115 extends along the upper end portion of the first side wall portion 131*b* of the rear medial foot side outsole 131.

While the concave portion 115 has a length provided thereof that is not particularly limited, it is preferable to be provided so as to overlap the above-stated specific region SR. Moreover, the concave portion 115 may extend toward the front side and/or the rear side of the specific region SR, by exceeding the front side specific location SP1 that is a front end of the specific region SR and/or the rear side specific location SP2 that is a rear end of the specific region SR.

In the case where being formed in such a manner, the first protruding portion 111 easily deforms with a portion where the concave portion 115 is provided as a base point. Accordingly, by being formed in such a manner, it becomes possible to further increase the deformability of the portion of the shoe sole 100B on the rear medial foot side, and as a result of this, a shock absorbing performance at the time of a cutting maneuver further improves.

Therefore, by having the shoe 1 and the shoe sole 100B included in the shoe 1 relating to the present embodiment, not only an effect the same as the effect described in the above-stated Embodiment 1 can be obtained, but also a shoe sole with a higher performance, and a shoe including the shoe sole, can be produced.

(Summary of the disclosed content in the embodiments) When summarizing the characteristic configurations disclosed in the above-stated Embodiments 1 and 2, these characteristic configurations are as follows.

A shoe sole according to a certain aspect of the present disclosure is a shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are provided to be connected along a front-rear direction that is a direction coinciding with a foot length direction of the foot of the wearer, the shoe sole including a midsole and an outsole. The midsole is provided so as to straddle across the forefoot portion, the midfoot portion, and the rearfoot portion. The outsole prescribes a ground contact surface when in a standing posture by covering at least a part of the midsole on a lower surface. The midsole has a first protruding portion protruding toward the ground contact surface side at a location on a medial foot side in a left-right direction that is a direction coinciding with a foot width direction of the foot of the wearer and on a rear end side in the front-rear direction. A portion of the midsole where the first protruding portion is provided includes a first bottom surface located on the ground contact surface side, and a first side surface located on the medial foot side in the left-right direction when seen from the first bottom surface. The outsole has a first cover portion including a first bottom wall portion prescribing the ground contact surface by covering the first bottom surface, and a first side wall portion erected facing upward from a peripheral edge of the first bottom wall portion on the medial foot side in the left-right direction and covering the first side surface. In a case where a front side end of the shoe sole in the front-rear direction is set as a reference, a location corresponding to a dimension of 70% of a dimension from the front side end to a rear side end of the shoe sole in the front-rear direction is set as a front side specific location, and a location of the first bottom wall portion on a rear end side in the front-rear direction is set as a rear side specific location, a first ridgeline of the first cover portion located at a boundary between the first bottom wall portion and the first side wall portion is located so as to separate from a first outline of the first cover portion prescribed by the first side wall portion from the front side specific location toward the rear side specific location in a case when seen along a normal direction of the ground contact surface.

In the shoe sole according to the certain aspect of the present disclosure, the first protruding portion and the first cover portion may be both located so as to straddle across the midfoot portion and the rearfoot portion.

In the shoe sole according to the certain aspect of the present disclosure, the first protruding portion and the first cover portion may be both located on the medial foot side from a center location in the left-right direction.

In the shoe sole according to the certain aspect of the present disclosure, the first side surface may include an upper side surface substantially orthogonal to the ground contact surface, and a lower side surface for smoothly connecting the first bottom surface and the upper side surface, and the first side wall portion may include an upper side first side wall portion covering the upper side surface, and a lower side first side wall portion covering the lower side surface. In this case, a second ridgeline of the first cover portion located at a boundary between the upper side first side wall portion and the lower side first side wall portion may be located so as to separate from a second outline of the first cover portion prescribed by the first bottom wall portion from the front side specific location toward the rear side specific location in a case when seen along the left-right direction.

In the shoe sole according to the certain aspect of the present disclosure, the midsole may have a second protruding portion protruding toward the ground contact surface side at a location on the lateral foot side in the left-right direction and on the rear end side in the front-rear direction. In this case, a portion of the midsole where the second protruding portion is provided may include a second bottom surface located on the ground contact surface side, and a second side surface located on the lateral foot side in the left-right direction when seen from the second bottom surface, and the outsole may have a second cover portion including a second bottom wall portion prescribing the ground contact surface by covering the second bottom surface, and a second side wall portion erected facing upward from a peripheral edge of the second bottom wall portion on the lateral foot side in the left-right direction and covering the second side surface.

In the shoe sole according to the certain aspect of the present disclosure, a groove portion of the midsole formed between the first protruding portion and the second protruding portion may include a portion extending along the front-rear direction, and in this case, in a case where drawing a virtual line connecting end points of the midsole prescribing an opening surface of the groove portion and a vertical bisector line of the virtual line in a cross section orthogonal to the front-rear direction at an arbitrary location from the front side specific location to the rear side specific location, an area surrounded by the virtual line, the vertical bisector line, and a portion of a contour line of the groove portion on the medial foot side may be larger than an area surrounded by the virtual line, the vertical bisector line, and a portion of a contour line of the groove portion on the lateral foot side.

In the shoe sole according to the certain aspect of the present disclosure, the first cover portion and the second cover portion may be made of different members separated from each other.

In the shoe sole according to the certain aspect of the present disclosure, a material forming the first cover portion and a material forming the second cover portion may be different.

In the shoe sole according to the certain aspect of the present disclosure, a constricted portion may be provided on an upper end portion of the first side wall portion.

In the shoe sole according to the certain aspect of the present disclosure, the midsole may include an outside exposed surface adjacent to an upper end portion of the first side wall portion and exposed above the first side wall portion, and in this case, a concave portion extending along the upper end portion of the first side wall portion may be provided on the outside exposed surface.

The shoe sole according to the certain aspect of the present disclosure may further include a reinforcing structure portion assembled on the midsole. In this case, the reinforcing structure portion may be disposed so as to overlap at least a part of the first cover portion in a case when seen along the normal direction of the ground contact surface, and also in this case, the first cover portion, the midsole, the reinforcing structure portion, and the midsole may be located in order from below to above by having the reinforcing structure portion embedded in the midsole at the portion where the reinforcing structure portion and the first cover portion are overlapping.

A shoe according to a certain aspect of the present disclosure includes the shoe sole according to the certain aspect of the present disclosure, and an upper located above the shoe sole.

(Other Embodiments) In the above-stated Embodiments 1 and 2, while an explanation has been performed by exemplifying a case where the first side wall portion located at a portion sandwiched by the first ridgeline and the first outline in the specific region SR is formed in a curved convex shape, the shape of this portion is not particularly limited to this, and may preferably be a non-concave surface shape such as a convex surface shape or a flat surface shape, or may be a concave surface shape such as a curved concave shape.

Moreover, in the above-stated Embodiments 1 and 2, while an explanation has been performed by exemplifying a shoe formed so that the upper body is brought into close contact with the foot by using a shoelace, it may be a shoe formed so that the upper body is brought into close contact with the foot by a hook fastener, or may be a shoe formed so that the upper body is brought into close contact with the foot by forming a sock shaped upper body and thereby only inserting the foot into the upper body. Namely, the shape of the upper is capable of being appropriately modified in accordance with the usage of the shoe.

In this way, the embodiments shown in the present disclosure are exemplifications for all of the points, and are not limited exemplifications. The technical scope of the present invention is defined by the claims, and includes all modifications within the meaning and scope equivalent to the description of the claims.

REFERENCE SIGNS LIST

1 shoe, 100A, 100B shoe sole, 110 midsole, 110A front side midsole, 110B rear side midsole, 111 first protruding portion, 111*a* first bottom surface, 111*b* first side surface, 111*b*1 upper side surface, 111*b*2 lower side surface, 112 second protruding portion, 112*a* second bottom surface, 112*b* second side surface, 113 groove portion, 113*a* opening surface, 114 outside exposed surface, 115 concave portion, 116 interposed portion, 120 reinforcing structure portion, 121 medial foot side reinforcing member, 121*a* medial foot side bar portion, 121*b* rear end portion, 122 lateral foot side reinforcing member, 122*a* lateral foot side bar portion, 122*b* rear end portion, 130 outsole, 131 rear medial foot side outsole, 131*a* first bottom wall portion, 131*b* first side wall portion, 131*b*1 upper side first side wall portion, 131*b*2 lower side first side wall portion, 131*c* constricted portion, 132 rear lateral foot side outsole, 132*a* second bottom wall portion, 132*b* second side wall portion, 133 front side outsole, 133*a* third bottom wall portion, 134 ground contact surface, 200 upper, 210 upper body, 220 shoe tongue, 230 shoelace, OL1 first outline, OL2 second outline, P1, P2 endpoint, R1 forefoot portion, R2 midfoot portion, R3 rearfoot portion, RL1 first ridgeline, RL2 second ridgeline, SP1 front side specific location, SP2 rear side specific location, SR specific region, VB vertical bisector line, VL virtual line

The invention claimed is:

1. A shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are connected along a front-rear direction that is a direction coinciding with a foot length direction of the foot of the wearer, the shoe sole comprising:

a midsole provided so as to straddle across the forefoot portion, the midfoot portion, and the rearfoot portion; and an outsole defining a ground contact surface when in a standing posture by covering at least a part of the midsole on a lower surface, wherein the midsole has a first protruding portion protruding toward the ground contact surface at a location on a medial foot side and on a rear end side in the front-rear direction, a portion of the midsole where the first protruding portion is provided includes a first bottom surface located proximal the ground contact surface, and a first side surface located on the medial foot side, the outsole has a first cover portion including a first bottom wall portion defining the ground contact surface by covering the first bottom surface, and a first side wall portion extending upward from a peripheral edge of the first bottom wall portion on the medial foot side and covering the first side surface, and a front side end of the shoe sole in the front-rear direction is set as a reference, a location corresponding to a dimension of 70% of a dimension from the front side end to a rear side end of the shoe sole in the front-rear direction is set as a front side specific location, a location of a rear end of the first bottom wall portion in the front-rear direction is set as a rear side specific location, and a first ridgeline of the first cover portion located at a boundary between the first bottom wall portion and the first side wall portion is spaced from a first outline of the first cover portion defined by the first side wall portion from the front side specific location toward the rear side specific location, wherein the first outline is located at an outermost surface of the first side wall portion on the medial foot side; and a distance between the first ridgeline and the first outline continuously increases from the front side specific location to the rear side specific location.

2. The shoe sole according to claim 1, wherein the first protruding portion and the first cover portion are both located so as to straddle across the midfoot portion and the rearfoot portion.

3. The shoe sole according to claim 1, wherein the first protruding portion and the first cover portion are both located between the medial foot side and a center location in the left-right direction.

4. The shoe sole according to claim 1, wherein the first side surface includes an upper side surface substantially orthogonal to the ground contact surface, and a lower side surface for connecting the first bottom surface and the upper side surface, the first side wall portion includes an upper side first side wall portion covering the upper side surface, and a lower side first side wall portion covering the lower side surface, and a second ridgeline of the first cover portion located at a boundary between the upper side first side wall portion and the lower side first side wall portion spaced from a second outline of the first cover portion defined by the first bottom wall portion from the front side specific location toward the rear side specific location.

5. The shoe sole according to claim 1, wherein the midsole has a second protruding portion protruding toward the ground contact surface side at a location on the lateral foot side and on the rear end side, a portion of the midsole where the second protruding portion is provided includes a second bottom surface located on the ground contact surface side, and a second side surface located on the lateral foot side, and the outsole has a second cover portion including a second bottom wall portion defining the ground contact surface by covering the second bottom surface, and a second side wall portion erected facing upward from a peripheral edge of the second bottom wall portion on the lateral foot side in the left-right direction and covering the second side surface.

6. The shoe sole according to claim 5, wherein a groove portion of the midsole formed between the first protruding portion and the second protruding portion includes a portion extending along the front-rear direction, and drawing a virtual line connecting end points of the midsole defining an opening surface of the groove portion and a vertical bisector line of the virtual line in a cross section orthogonal to the front-rear direction at an arbitrary location from the front side specific location to the rear side specific location, an area surrounded by the virtual line, the vertical bisector line, and a portion of a contour line of the groove portion on the medial foot side is larger than an area surrounded by the virtual line, the vertical bisector line, and a portion of a contour line of the groove portion on the lateral foot side.

7. The shoe sole according to claim 5, wherein the first cover portion and the second cover portion are made of different members separated from each other.

8. The shoe sole according to claim 7, wherein a material forming the first cover portion and a material forming the second cover portion are different.

9. The shoe sole according to claim 1, wherein a constricted portion is provided on an upper end portion of the first side wall portion.

10. The shoe sole according to claim 1, wherein the midsole includes an outside exposed surface adjacent to an upper end portion of the first side wall portion and exposed above the first side wall portion, and a concave portion extending along the upper end portion of the first side wall portion is provided on the outside exposed surface.

11. The shoe sole according to claim 1, further comprising:

a reinforcing structure portion assembled on the midsole, wherein the reinforcing structure portion is disposed so as to overlap at least a part of the first cover portion such that an overlapping portion is visible along the normal direction of the ground contact surface, and a first part of, the midsole is located above the first cover portion, the reinforcing structure portion is located above the first part of the midsole, and a second part of the midsole is located above the reinforcing structure portion; and the reinforcing structure portion is embedded in the midsole at the overlapping portion.

12. A shoe comprising:

the shoe sole according to claim 1; and an upper located above the shoe sole.

13. A shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are connected along a front-rear direction that is a direction coinciding with a foot length direction of the foot of the wearer, the shoe sole comprising:

a midsole provided so as to straddle across the forefoot portion, the midfoot portion, and the rearfoot portion; and an outsole defining a ground contact surface when in a standing posture by covering at least a part of the midsole on a lower surface, wherein the midsole has a first protruding portion protruding toward the ground contact surface at a location on a medial foot side and on a rear end side in the front-rear direction, a portion of the midsole where the first protruding portion is provided includes a first bottom surface located proximal the ground contact surface, and a first side surface located on the medial foot side, the outsole has a first cover portion including a first bottom wall portion defining the ground contact surface by covering the first bottom surface, and a first side wall portion extending upward from a peripheral edge of the first bottom wall portion on the medial foot side and covering the first side surface, and a front side end of the shoe sole in the front-rear direction is set as a reference, a location corresponding to a dimension of 70% of a dimension from the front side end to a rear side end of the shoe sole in the front-rear direction is set as a front side specific location, a location of a rear end of the first bottom wall portion in the front-rear direction is set as a rear side specific location, and a first ridgeline of the first cover portion located at a boundary between the first bottom wall portion and the first side wall portion is spaced from a first outline of the first cover portion defined by the first side wall portion from the front side specific location toward the rear side specific location, wherein the first outline is located at an outermost surface of the first side wall portion on the medial foot side;

a distance between the first ridgeline and the first outline continuously increases from the front side specific location to the rear side specific location;

the first side surface includes an upper side surface substantially orthogonal to the ground contact surface, and a lower side surface for connecting the first bottom surface and the upper side surface;

the first side wall portion includes an upper side first side wall portion covering the upper side surface, and a lower side first side wall portion covering the lower side surface;

a second ridgeline of the first cover portion located at a boundary between the upper side first side wall portion and the lower side first side wall portion is spaced from a second outline of the first cover portion defined by the ground contact surface at the first bottom wall portion from the front side specific location toward the rear side specific location; and a distance between the second ridgeline and the second outline continuously increases from the front side specific location to the rear side specific location.

* * * * *